US006788132B2

(12) United States Patent
Lim et al.

(10) Patent No.: US 6,788,132 B2
(45) Date of Patent: Sep. 7, 2004

(54) VOLTAGE AND TIME CONTROL CIRCUITS

(75) Inventors: Kyu-Nam Lim, Yongin (KR); Sang-Seok Kang, Suwon (KR); Seong-Jin Jang, Suwon (KR)

(73) Assignee: Samsung Electronics Co., Ltd. (KR)

( * ) Notice: Subject to any disclaimer, the term of this patent is extended or adjusted under 35 U.S.C. 154(b) by 20 days.

(21) Appl. No.: 10/147,553

(22) Filed: May 17, 2002

(65) Prior Publication Data

US 2002/0171472 A1 Nov. 21, 2002

(30) Foreign Application Priority Data

May 17, 2001 (KR) ..... 2001-26998

(51) Int. Cl.[7] ..... G05F 3/02

(52) U.S. Cl. ..... 327/540; 327/535; 327/538

(58) Field of Search ..... 327/530, 535, 327/537, 538, 540, 541, 543, 545, 546, 56, 59, 60, 63, 70, 73, 77, 87, 88, 89, 97, 108, 311–317, 322; 361/18

(56) References Cited

U.S. PATENT DOCUMENTS 5,105,102 A * 4/1992 Shioda ..... 326/73
5,283,762 A * 2/1994 Fujishima ..... 365/189.09
5,309,399 A * 5/1994 Murotani ..... 365/189.09
5,457,421 A * 10/1995 Tanabe ..... 327/530
5,689,460 A * 11/1997 Ooishi ..... 365/189.07
6,008,674 A * 12/1999 Wada et al. ..... 327/89
6,046,624 A * 4/2000 Nam et al. ..... 327/530
6,097,180 A * 8/2000 Tsukude et al. ..... 323/313
6,281,716 B1 * 8/2001 Mihara ..... 327/80
6,373,754 B1 * 4/2002 Bae et al. ..... 365/189.09

* cited by examiner

*Primary Examiner*—Timothy P. Callahan
*Assistant Examiner*—Hai L. Nguyen
(74) *Attorney, Agent, or Firm*—Myers Bigel Sibley & Sajovec P.A.

(57) ABSTRACT

Integrated circuits are provided that include a voltage control circuit that is configured to adjust a circuit voltage that is outside a predetermined circuit voltage specification to within the predetermined circuit voltage specification so that the integrated circuit device is no longer defective. Integrated circuits are also provided that include a signal time delay control circuit that is configured to adjust a circuit delay time that is outside a predetermined circuit delay time specification to within the predetermined circuit delay time specification so that the integrated circuit device is no longer defective. Corresponding methods of operation are also provided.

10 Claims, 17 Drawing Sheets

VOLTAGE AND TIME CONTROL CIRCUITS

RELATED APPLICATION

This application is related to and claims priority from Korean Application No. 2001-26998, filed May 17, 2001, the disclosure of which is hereby incorporated herein by reference.

FIELD OF THE INVENTION

The present invention relates to integrated circuit devices and methods of operating the same and, more particularly, to control circuits for integrated circuit devices and methods of controlling the same.

BACKGROUND OF THE INVENTION

In conventional integrated circuit devices, in order to determine whether the device is normal, i.e. not defective, parameters such as voltage and time are measured at a package level. If the measured parameters satisfy a predetermined value of the integrated circuit device, for example, an integrated circuit memory device, the integrated circuit memory device may be regarded as normal. On the other hand, if the measured parameters do not satisfy the predetermined value, the integrated circuit memory device may be regarded as defective.

Parameters that are typically measured may include, for example, internal power voltage, high voltage, substrate voltage, a time period tSAC (time from generation of a clock signal to time of valid data output) and output data hold time tOH. If these parameters do not meet the predetermined specifications at a package level, the integrated circuit device may be regarded as defective and be discarded. Accordingly, each time an integrated circuit device is discarded due to a nonconforming parameter, the manufacturing yield of integrated circuit memory devices may be lowered.

SUMMARY OF THE INVENTION

Embodiments of the present invention provide integrated circuit devices including a voltage control circuit that is configured to adjust a circuit voltage that is outside a predetermined circuit voltage specification to within the predetermined circuit voltage specification so that the integrated circuit device is no longer defective.

In some embodiments of the present invention the predetermined circuit voltage specification is a reference voltage and the voltage control circuit increases and/or decreases the circuit voltage based on a relationship between the circuit voltage and the reference voltage.

In some embodiments of the present invention, the voltage control circuit may increase the circuit voltage if the circuit voltage is less than the reference voltage and/or may decrease the circuit voltage if the circuit voltage is greater than the reference voltage.

In further embodiments of the present invention, the circuit voltage may include at least one of an internal power voltage, a bit line pre-charge voltage, a high voltage and a substrate voltage.

In still further embodiments of the present invention, the voltage control circuit may be an internal power voltage generating circuit and the circuit voltage may be an internal power voltage. The internal power generating circuit may include a mode setting unit that receives a plurality of input signals and sets at least one input control signal responsive to the plurality of input signals. The internal power generating circuit may further include a voltage level control unit that sets the state of at least one output control signal responsive to the at least one input control signal and turns a switching circuit on and/or off in response to the at least one output control signal. Finally, the internal power generating circuit may include an internal power voltage generating unit that compares the internal power voltage received from the switching circuit to the reference voltage and increases and/or decreases the internal power voltage responsive to the relationship between the internal power voltage and the reference voltage.

In some embodiments of the present invention, the voltage level control unit may include a control signal generating circuit and a switching circuit. The control signal generating circuit may set the state of the at least one output control signal responsive to the at least one input control signal.

In further embodiments of the present invention the voltage control circuit may include a bit line pre-charge voltage generating circuit and the circuit voltage may include a bit line pre-charge voltage. The bit line pre-charge voltage generating circuit may include a mode setting unit, a first voltage level control unit, a second voltage level control unit, and a bit line pre-charge voltage generating unit. The mode selecting unit may receive a plurality of input signals and set at least one first input control signal and at least one second input control signal responsive to the plurality of input signals. The first voltage level control unit may set the state of at least one first output control signal responsive to the at least one first input control signal and turn a first switching circuit on and/or off in response to the at least one first output control signal. The second voltage level control unit may set the state of at least one second output control signal responsive to the at least one second input control signal and turn a second switching circuit on and/or off in response to the at least one second output control signal. Finally, the bit line pre-charge voltage generating unit may compare the bit line pre-charge voltage to the reference voltage and increases and/or decreases the bit line pre-charge voltage responsive to the relationship between the bit line pre-charge voltage and the reference voltage.

In still further embodiments of the present invention voltage control circuit may include a substrate voltage level detecting circuit and the circuit voltage may include a substrate voltage. The substrate voltage level detecting circuit may include a mode setting unit, a first voltage level control unit, a second voltage level control unit, and a substrate voltage detecting unit. The mode setting unit may receive a plurality of input signals and may set at least one first input control signal and at least one second input control signal responsive to the plurality of input signals. The first voltage level control unit may set the state of at least one first output control signal responsive to the at least one first input control signal and may turn a first switching circuit on and/or off in response to the at least one first output control signal. The second voltage level control unit may set the state of at least one second output control signal responsive to the at least one second input control signal and may turn a second switching circuit on and/or off in response to the at least one second output control signal. Finally, the substrate voltage detecting unit may compare the substrate voltage to the reference voltage and increase and/or decrease the substrate voltage responsive to the relationship between the substrate voltage and the reference voltage.

In some embodiments of the present invention, the voltage control circuit may include a high voltage level detecting circuit and the circuit voltage may include a high voltage. The high voltage level detecting circuit may include a mode setting unit, a first voltage level control unit, a second voltage level control unit, and a high voltage detecting unit. The mode setting unit may receive a plurality of input signals and may set at least one first input control signal and at least one second input control signal responsive to the plurality of input signals. The first voltage level control unit may set the state of at least one first output control signal responsive to the at least one first input control signal and may turn a first switching circuit on and/or off in response to the at least one first output control signal. The second voltage level control unit may set the state of at least one second output control signal responsive to the at least one second input control signal and turns a second switching circuit on and/or off in response to the at least one second output control signal. Finally, a high voltage level detecting unit may compare the high voltage to the reference voltage and increase and/or decrease the high voltage responsive to the relationship between the high voltage and the reference voltage.

In further embodiments of the present invention a signal delay time control circuit is provided. The signal time delay control circuit may be configured to adjust a circuit delay time that is outside a predetermined circuit delay time specification to within the predetermined circuit delay time specification so that the integrated circuit device is no longer defective.

In still further embodiments of the present invention the predetermined circuit delay time is a reference delay time and the signal delay time control circuit increases and/or decreases the circuit delay time responsive to the relationship between the circuit delay time and the reference delay time.

In still further embodiments of the present invention, methods of operating a voltage and/or time control circuit are provided according to embodiments of the present invention.

DETAILED DESCRIPTION OF EMBODIMENTS OF THE PRESENT INVENTION

Figure 1:
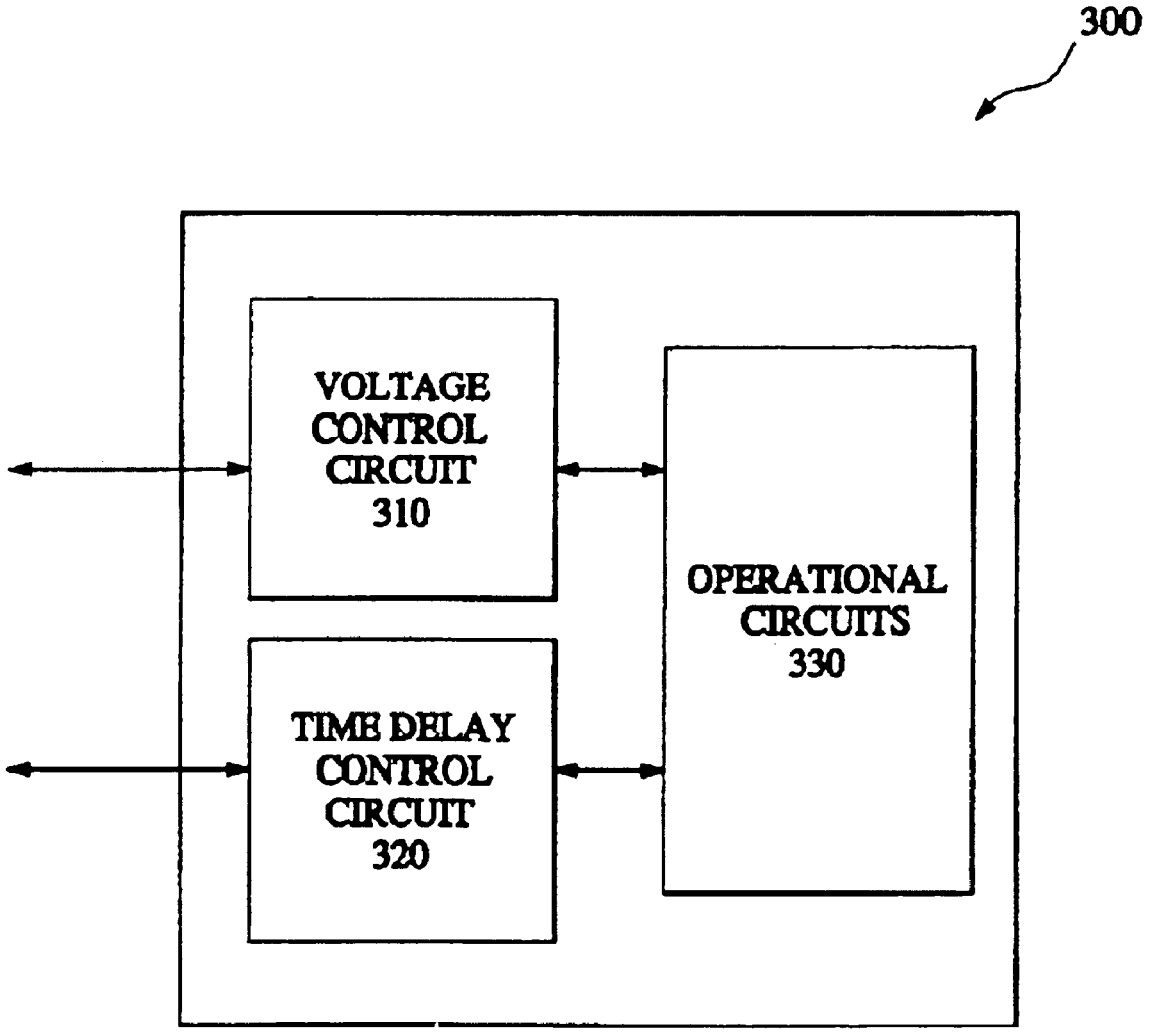
FIG. 1 is a block diagram of an integrated circuit package illustrating the control circuits according to embodiments of the present invention.

The present invention will now be described more fully with reference to the accompanying drawings, in which embodiments of the invention are shown. This invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like reference numerals refer to like elements throughout.

Embodiments of the present invention will now be described in detail below with reference to FIGS. 1 through 17, which illustrate various embodiments of the present invention and various operation methods according to embodiments of the present invention. An integrated circuit device, for example, an integrated circuit memory device, is provided having voltage and/or time control circuits. Voltages control circuits may control different types of circuit voltages, such as internal power voltage, high voltage, substrate voltage and/or a bit line pre-charge voltage. Time control circuits may also be used to control different timing parameters, such as a time period tSAC (time from generation of a clock signal to time of valid data output) and output data hold time tOH. The presence of the voltage and/or time control circuits in the integrated circuit device may allow the voltages and/or time delays of the integrated circuit devices to be adjusted to coincide with standard voltages and/or time delays. The ability to adjust the voltages and/or time delays may decrease the likelihood that an integrated circuit will be discarded as defective and, therefore, may increase the manufacturing yield of these integrated circuit devices.

Control circuits according to embodiments of the present invention may be included in integrated circuit packages, for example, the integrated circuit package 300 illustrated in FIG. 1. As illustrated in FIG. 1, the integrated circuit package may include a voltage control circuit 310 according to embodiments of the present invention, a time delay control circuit 320 according to embodiments of the present invention, and operational circuits 330 to provide the particular functionality of the selected integrated circuit package 300. For example, the integrated circuit package 300 may be directed to an integrated circuit memory device.

The voltage control circuit 310 in FIG. 1 may be configured to adjust a circuit voltage that is outside a predetermined circuit voltage specification to within the predetermined circuit voltage specification so that the integrated circuit device is no longer defective. Similarly, the time delay control circuit 320 may be configured to adjust a circuit delay time that is outside a predetermined circuit delay time specification to within the predetermined circuit delay time specification so that the integrated circuit device is no longer defective. Embodiments of the voltage control circuit and the time delay control circuit according to embodiments of the present invention will be discussed further below with respect to FIGS. 2 through 17.

It will be understood that although the integrated circuit package 300 of FIG. 1 includes both a voltage control circuit 310 and time control circuit 320, the present invention should not be limited to this configuration. Alternatively, the integrated circuit package may only include the voltage control circuit 310 or it may only include the time control circuit 320 without departing from the teachings of the present invention.

Figure 2:
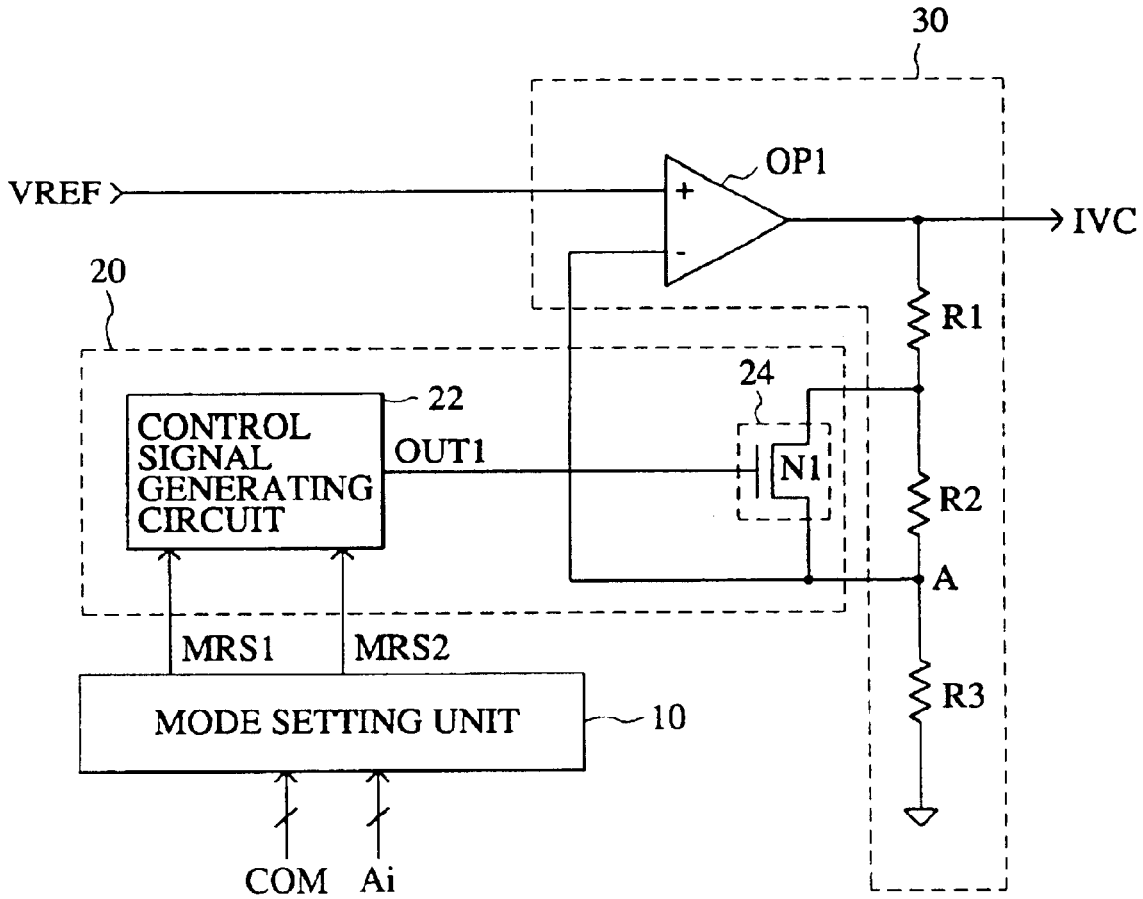
FIG. 2 is a circuit block diagram illustrating internal power voltage generating circuits according to embodiments of the present invention.

Referring now to FIG. 2, a circuit block diagram illustrating internal power voltage generating circuits according to embodiments of the present invention will be discussed. As illustrated in FIG. 2, the internal power voltage generating circuit includes a mode setting unit 10, a voltage level control unit 20 and an internal power voltage generating unit 30. The voltage level control unit 20 may include a control signal generating circuit 22 and a switching circuit 24. The switching circuit 24 may include an NMOS transistor N1. The internal power voltage generating unit 30 may include an amplifier OP1 and resistors R1, R2 and R3.

As further illustrated in FIG. 2, the mode setting unit 10 receives a command signal COM and a data signal Ai and sets control signals MRS1 and MRS2 responsive to the command signal COM and the data signal Ai. The command signal COM typically includes an inverted chip selecting signal having a logic "low" level, an inverted row address strobe signal, an inverted column address strobe signal, and an inverted write enable signal. The data signal Ai is applied through an address input pin (not shown). The control signal generating circuit 22 sets a state of an output control signal OUT1 in response to the control signals MRS1 and MRS2 at a package level. The NMOS transistor N1 (the switching circuit 24) is turned on when the control signal OUT1 is a logic "high" level. The amplifier OP1 compares a voltage at a node A with a reference voltage VREF, and decreases a level of an internal power voltage IVC if the voltage at the node A is greater than the reference voltage VREF. Similarly, the amplifier OP1 increases the level of the internal power voltage IVC when the voltage at node A is smaller than the reference voltage VREF. The resistors R1, R2 to R3 serve to divide the internal power voltage IVC.

The internal power voltage generating circuit of FIG. 2 outputs the internal power voltage IVC having a voltage level equal to (R1+R2+R3)VREF/R3 when the control signal OUT1 is a logic "low" level, and outputs the internal power voltage IVC equal to (R1+R3)VREF/R3 when the control signal OUT1 is a logic "high" level. In other words, when the internal power voltage IVC is higher than a reference internal power voltage, the internal power voltage generating circuit of FIG. 2 sets the control signal OUT1 to a logic "high" level to lower the voltage level of the internal power voltage IVC.

Figure 3:
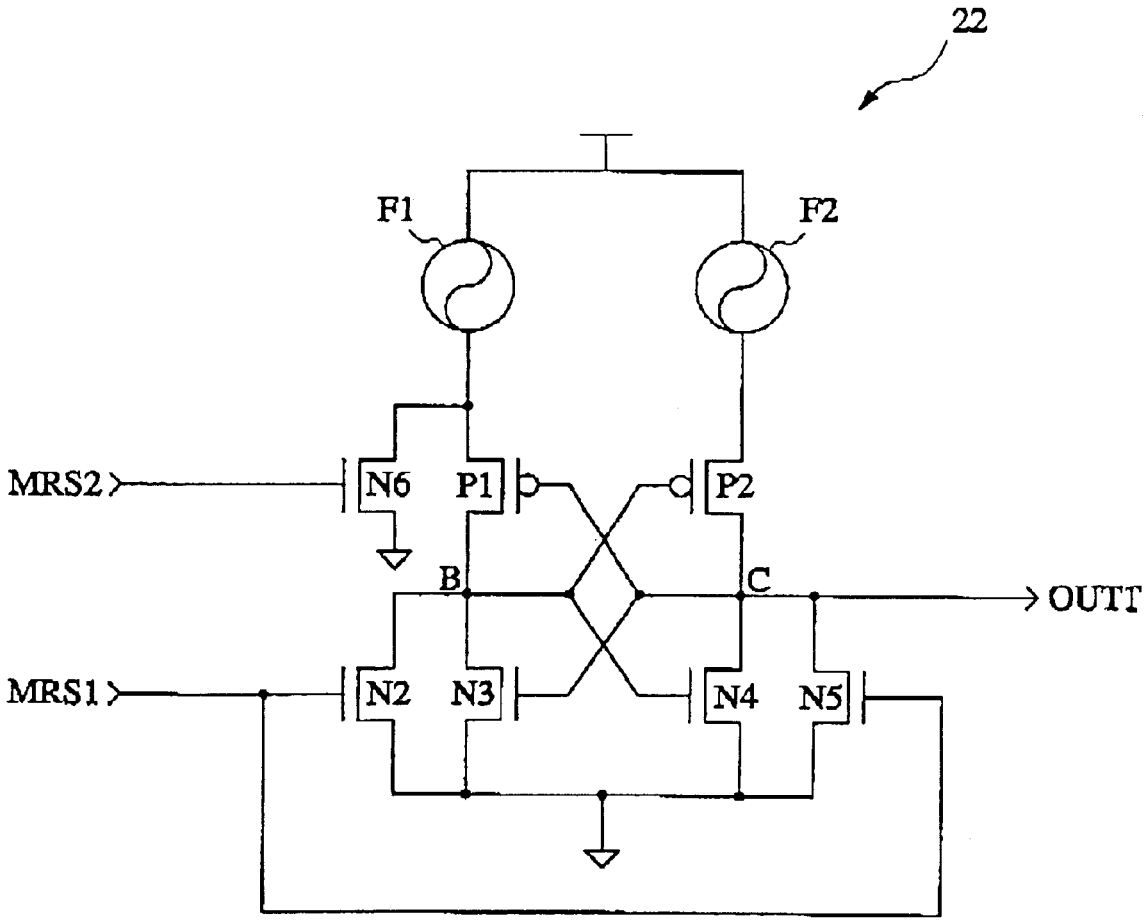
FIG. 3 is a circuit block diagram illustrating control signal generating circuits according to embodiments of the present invention illustrated in FIG. 2.

Referring now to FIG. 3, a circuit diagram illustrating the control signal generating circuit 22 according to embodiments of the present invention illustrated in FIG. 2 will be discussed. As illustrated, the control signal generating circuit 22 includes second through sixth NMOS transistors N2, N3, N4, N5 and N6, first and second PMOS transistors P1 and P2, and first and second fuses F1 and F2. The fuse F1 is typically smaller in resistance value than the fuse F2 by design.

When control signal MRS2 is a logic "low" and the control signal MRS1 is a logic "high", the NMOS transistors N2 and N5 are turned on. Accordingly, the voltage level at a node B becomes slightly higher than a voltage level at a node C. In this state, when the control signal MRS1 transitions from a logic "high" level to a logic "low" level, the NMOS transistors N2 and N5 are turned off. The NMOS transistor N4 turns on stronger than the NMOS transistor N3 and, thus, the voltage level at node B becomes higher and the voltage level at node C becomes lower. As a result, the output signal OUT1 is a logic "low".

When the control signal MRS2 is a logic "high" level, the first fuse F1 is blown. Thus, the first fuse F1 becomes higher in resistance than the second fuse F2. In this state, when the control signal MRS1 is a logic "high" level, the NMOS transistors N2 and N5 are turned on. Consequently, the voltage level at node B becomes slightly lower than the voltage level at node C. When the control signal MRS1 transitions from a logic "high" level to a logic "low" level, the NMOS transistors N2 and N5 are turned off, and the NMOS transistor N3 turns on stronger than the NMOS transistor N4. Thus, the voltage at node C becomes higher, and the voltage level at node B becomes lower. As a result, the output signal OUT1 is a logic "high". In other words, the level of the control signal OUT1 can be adjusted using the control signal generating circuit 22 illustrated in FIG. 3.

Figure 4:
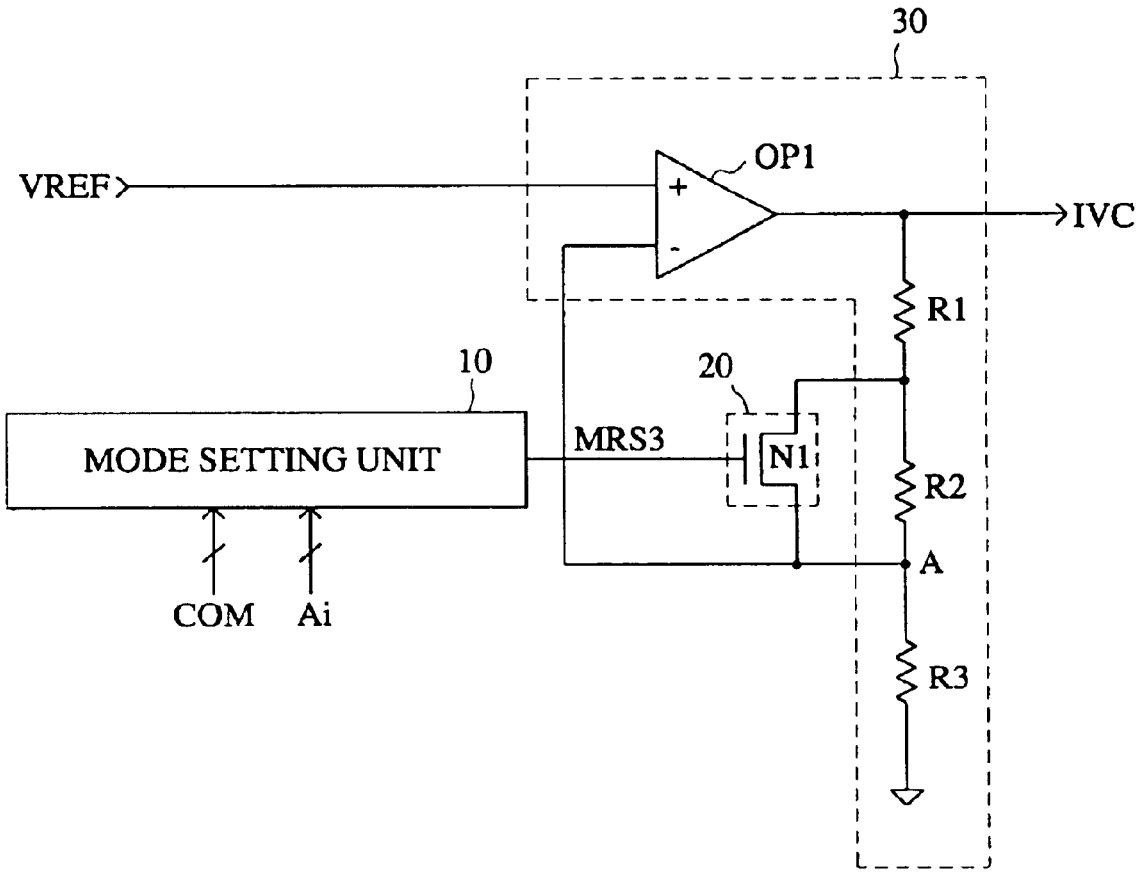
FIG. 4 is a circuit block diagram illustrating internal power voltage generating circuits according to further embodiments of the present invention.

Referring now to FIG. 4, a circuit block diagram of internal power voltage generating circuits according to further embodiments of the present invention will be discussed below. As illustrated in FIG. 4, the internal power voltage generating circuit includes a mode setting unit 10, a voltage level control unit 20, and an internal power voltage generating unit 30. The voltage level control unit 20 includes an NMOS transistor N1. The internal power voltage generating unit 30 includes an amplifier OP1 and resistors R1, R2 and R3.

The mode setting unit 10 receives a command signal COM and a data signal Ai through an address input pin (not shown) and sets the state of a control signal MRS3. The NMOS transistor N1 turns on when the control signal MRS3 is a logic "high" level. When the internal power voltage IVC is higher than the reference internal power voltage and the control signal MRS3 is a logic "low", the control signal MRS3 is set to a logic "high" level to lower a level of the internal power voltage IVC.

It will be understood that the internal power voltage generating circuit of FIG. 2 can fix a level of the control signal OUT1, but the internal power voltage generating circuit of FIG. 4 may set the level of the control signal MRS3 whenever needed because the internal power voltage generating circuit of FIG. 4 does not include a control signal generating circuit 22.

Figure 5:
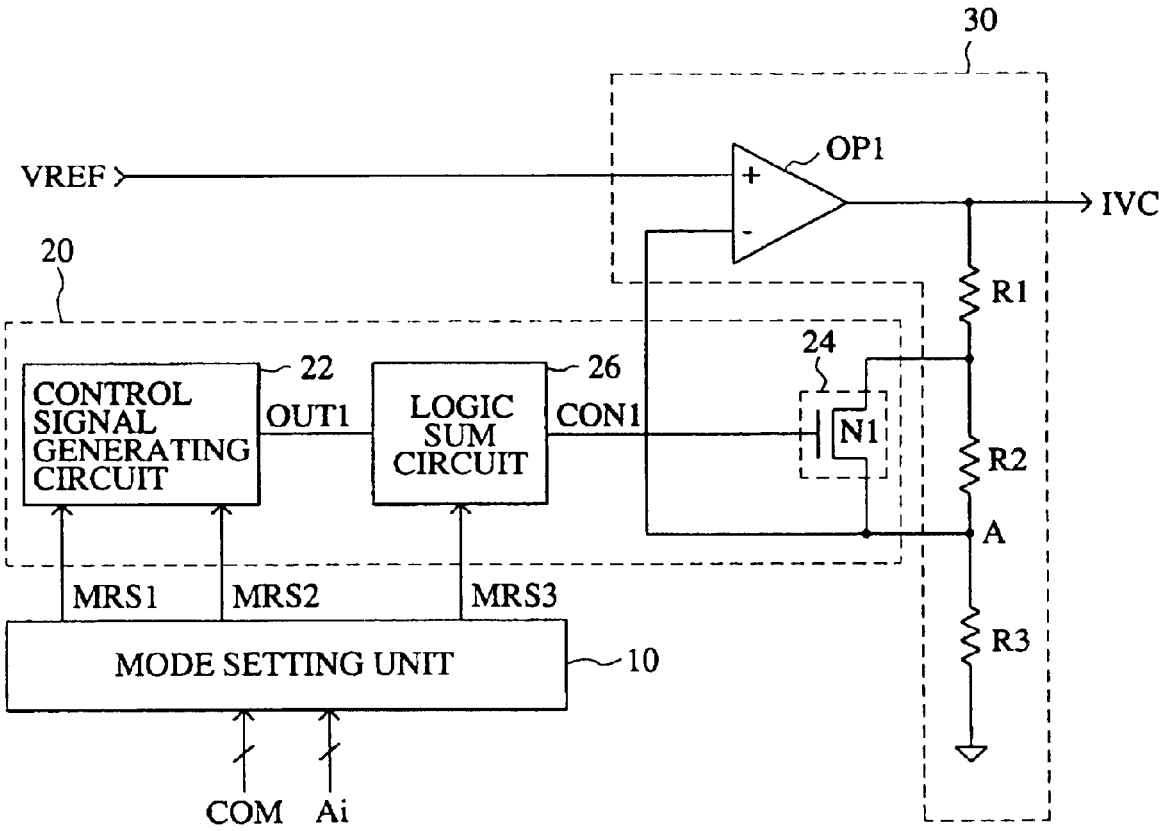
FIG. 5 is a circuit block diagram illustrating internal power voltage generating circuits according to further embodiments of the present invention.

Referring now to FIG. 5, a circuit block diagram illustrating internal power voltage generating circuits according to further embodiment of the present invention will be discussed below. As illustrated in FIG. 5, the internal power voltage generating circuit includes a mode setting unit 10, a voltage level control unit 20 and an internal power voltage generating unit 30. The voltage level control unit 20 includes a control signal generating circuit 22, a switching circuit 24 and a logic sum circuit 26. The switching circuit 24 includes an NMOS transistor N1. The internal power voltage generating unit 30 includes an amplifier OP1 and resistors R1, R2 and R3.

The mode setting unit 10 receives a command signal COM and a data signal Ai through an address input pin (not shown) and sets control signals MRS1, MRS2 and MRS3. The control signal generating circuit 22 sets a state of an output signal OUT1 in response to the control signals MRS1 and MRS2 at a package level. The logic sum circuit 26 logic-sums the output signal OUT1 and the control signal MRS3 and generates a control signal CON1. The NMOS transistor N1 turns on when the control signal CON1 is a logic "high" level. The internal power voltage generating unit 30 performs similar operations as discussed above with respect to FIG. 2.

The internal power voltage generating circuit of FIG. 5 fixes a state of the output signal OUT1 using control signals MRS1 and MRS2 or sets a state of the control signal MRS3 whenever operated. Therefore, when a level of the internal power voltage IVC is higher than the reference internal power voltage, it is possible to lower a level of the internal power voltage IVC.

Figure 6:
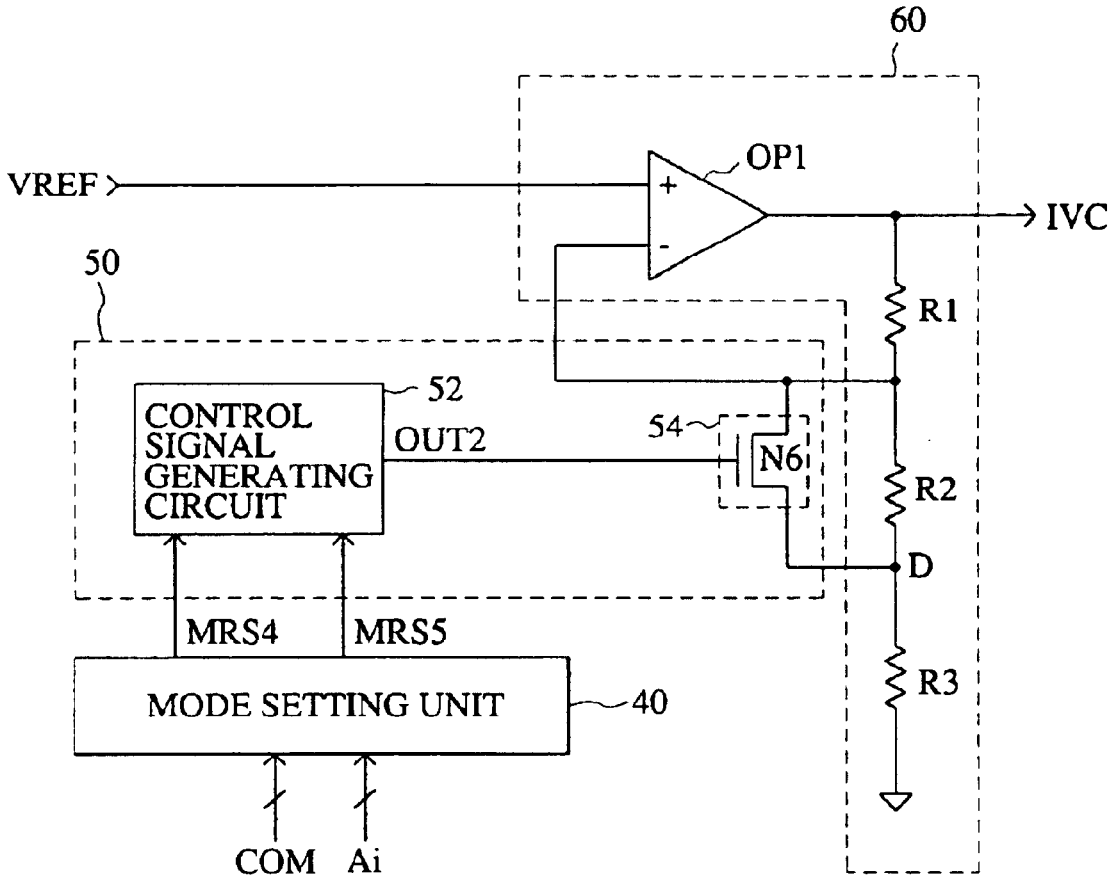
FIG. 6 is a circuit block diagram illustrating internal power voltage generating circuits according to further embodiments of the present invention.

Referring now to FIG. 6, a circuit block diagram illustrating internal power voltage generating circuits according to further embodiments of the present invention will be discussed below. As illustrated in FIG. 6, the internal power voltage generating circuit may include a mode setting unit 40, a voltage level control unit 50 and an internal power voltage generating unit 60. The voltage level control unit 50 includes a control signal generating circuit 52 and a switching circuit 54. The switching circuit 54 includes an NMOS transistor N6. The internal power voltage generating unit 60 includes an amplifier OP1 and resistors R1, R2 and R3.

The mode setting unit 40 receives a command signal COM and a data signal Ai through an address pin (not shown) and sets control signals MRS4 and MRS5. The control signal generating circuit 52 sets a state of a control signal OUT2 in response to the control signals MRS4 and MRS5 at a package level. The NMOS transistor N6 turns on when the control signal OUT2 is a logic "high" level. The amplifier OP1 compares the voltage node D with a reference voltage VREF. The level of the internal power voltage IVC is decreased when the voltage at node D is greater than the reference voltage and increased when the level of the voltage at node D is smaller than a level of the reference voltage. The resistors R1, R2 and R3 divide the internal power voltage IVC.

The internal power voltage generating circuit of FIG. 6 may output the internal power voltage IVC having a voltage level equal to (R1+R2+R3)VREF/(R2+R3) when the control signal OUT2 is a logic "low" level, and may output the internal power voltage IVC having voltage level equal to (R1+R3)VREF/R3 when the control signal OUT2 is a logic "high" level. In other words, when the internal power voltage IVC is smaller than the reference voltage and the control signal OUT2 is generated, i.e. not set, it is possible to increase the level of the internal power voltage IVC by generating the control signal OUT2 having a logic "high" level. The control signal generating circuit 52 of FIG. 6 has a similar functionality as the control signal generating circuit illustrated in FIG. 3.

Figure 7:
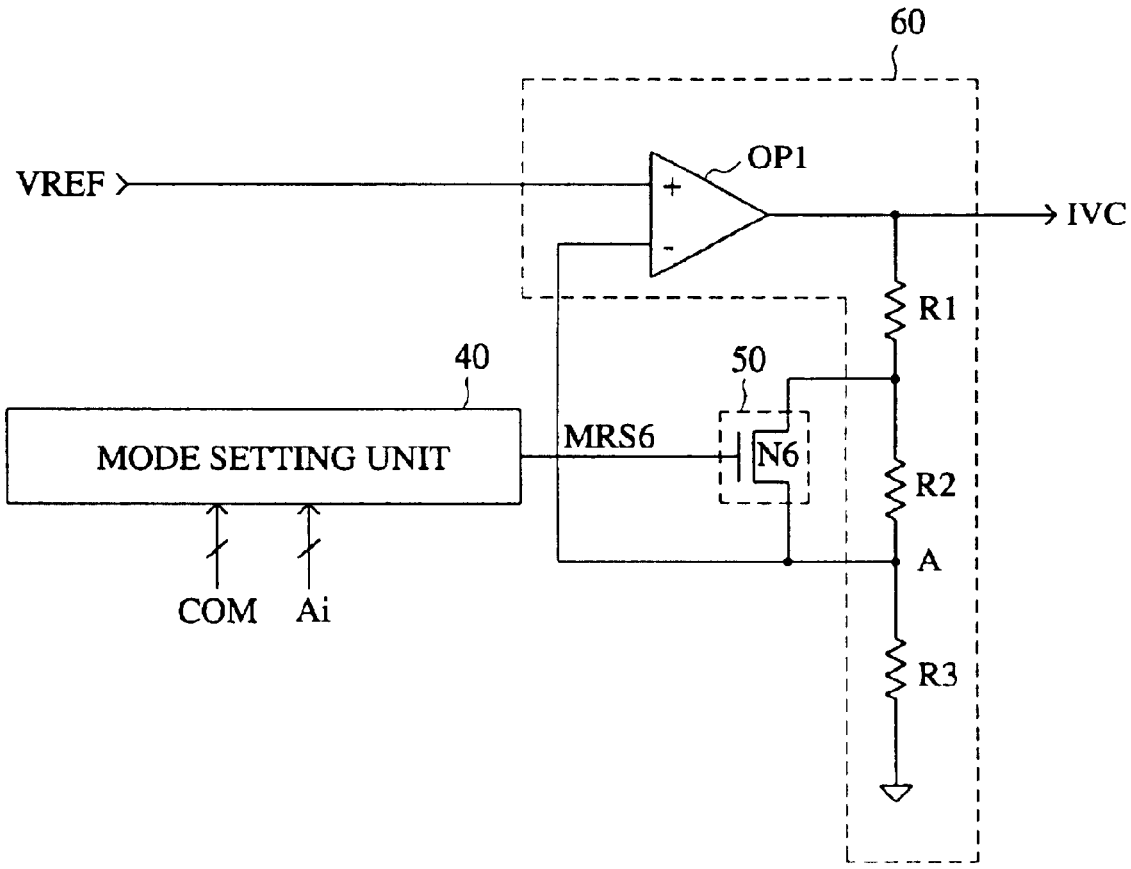
FIG. 7 is a circuit block diagram illustrating internal power voltage generating circuits according to further embodiments of the present invention.

Referring now to FIG. 7, a circuit block diagram illustrating internal power voltage generating circuits according further embodiments of the present invention will be discussed. As illustrated in FIG. 7, the internal power voltage generating circuit of includes a mode setting unit 40, a voltage level control unit 50, and an internal power voltage generating unit 60. The voltage level control unit 50 includes an NMOS transistor N6. The internal power voltage generating unit 60 includes an amplifier OP1 and resistors R1, R2 and R3.

The mode setting unit 40 receives a command signal COM and a data signal Ai through an address pin (not shown) and sets a control signal MRS6. The NMOS transistor N6 turns on when the control signal MRS6 is a logic "high" level. The internal power voltage generating circuits of FIGS. 5 and 6 perform similar operations. When the internal power voltage IVC is lower than the reference voltage and is generated when the control signal MRS6 is a logic "low" level, the internal power voltage generating circuit sets the control signal MRS6 having a logic "high" level to increase a level of the internal power voltage IVC.

It will be understood that the internal power voltage generating circuit of FIG. 6 can fix a level of the control signal OUT2, but the internal power voltage generating circuit of FIG. 7 may set the level of the control signal MRS6 whenever needed because the internal power voltage generating circuit of FIG. 7 does contain a control signal generating circuit 52.

Figure 8:
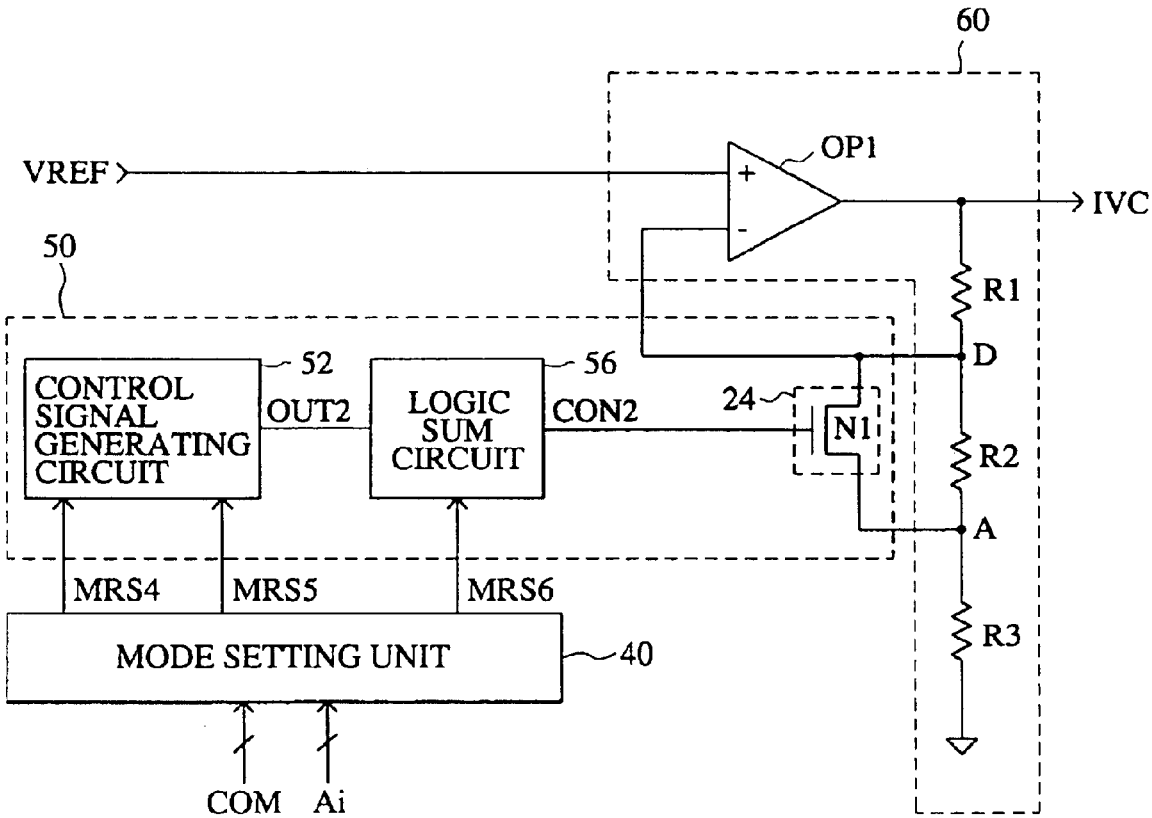
FIG. 8 is a circuit block diagram illustrating internal power voltage generating circuits according to further embodiments of the present invention.

Referring now to FIG. 8, a circuit block diagram illustrating internal power voltage generating circuits according to further embodiments of the present invention will be discussed below. As illustrated in FIG. 8, the internal power voltage generating circuit includes a mode setting unit 40, a voltage level control unit 50 and an internal power voltage generating unit 60. The voltage level control unit 50 includes a control signal generating circuit 52, a switching circuit 54 and a logic sum circuit 56. The switching circuit 54 includes an NMOS transistor N6. The internal power voltage generating unit 60 includes an amplifier OP1 and resistors R1, R2 and R3.

The mode setting unit 40 receives a command signal COM and a data signal Ai through an address input pin (not shown) and sets the control signals MRS4, MRS5 and MRS6. The control signal generating circuit 52 sets a state of an output signal OUT2 in response to the control signals MRS4 and MRS5 at a package level. The logic sum circuit 56 logic-sums the output signal OUT2 and the control signal MRS6 to generate a control signal CON2. The NMOS transistor N6 turns on when the control signal CON2 is a logic "high" level. The internal power voltage generating unit 60 performs similar operations to the internal power voltage generating unit of FIG. 5.

The internal power voltage generating circuit of FIG. 8 may fix a state of the output signal OUT2 using control signals MRS4 and MRS5 or may set a state of the control signal MRS6 whenever operated. Therefore, when a level of the internal power voltage IVC is higher than the reference voltage, it may be possible to lower a level of the internal power voltage IVC.

Figure 9:
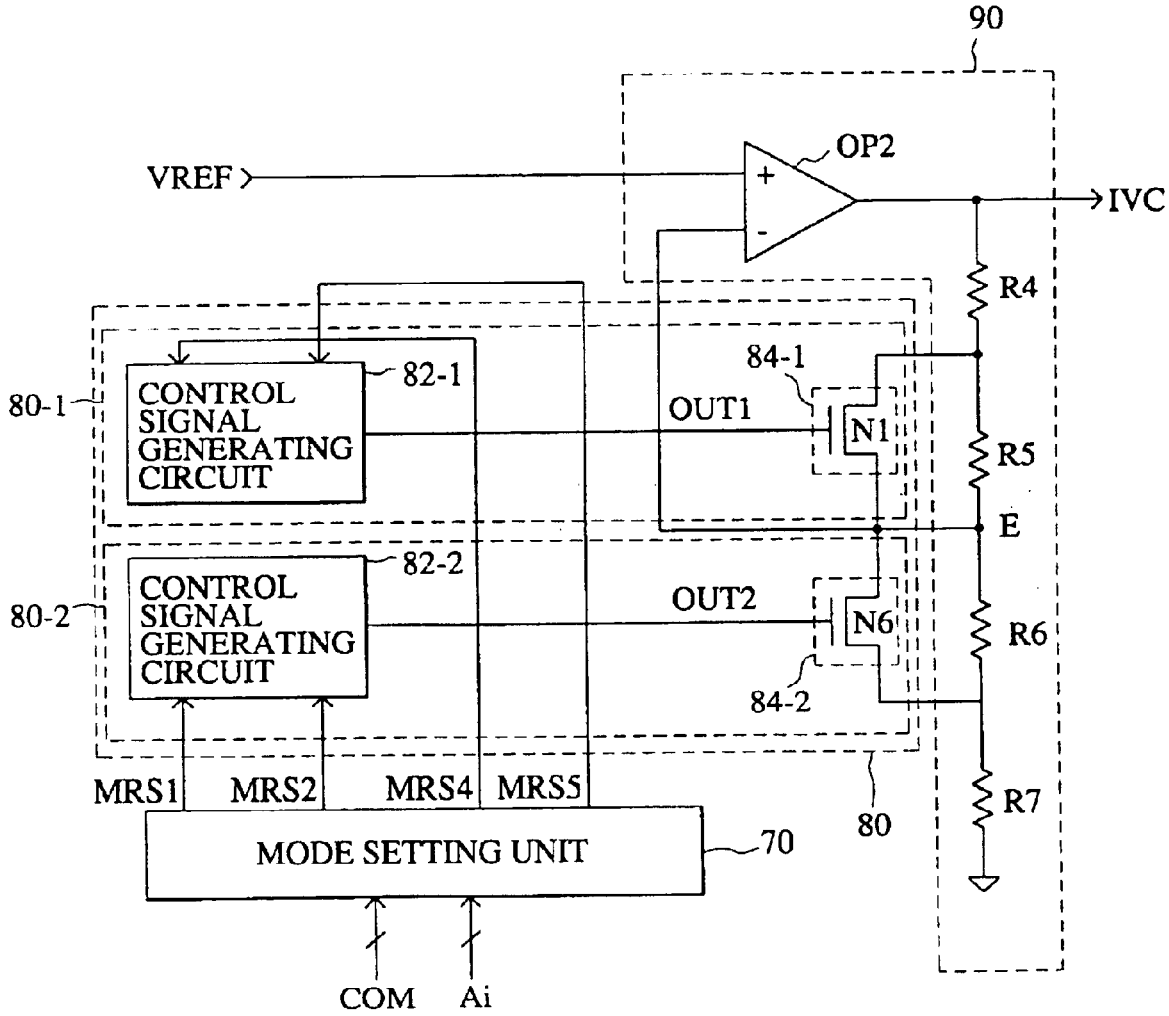
FIG. 9 is a circuit block diagram illustrating internal power voltage generating circuits according to further embodiments of the present invention.

Referring now to FIG. 9, a circuit block diagram illustrating internal power voltage generating circuits according to further embodiments of the present invention will be discussed below. As illustrated in FIG. 9, the internal power voltage generating circuit may include a mode setting unit 70, a voltage level control unit 80 and an internal power voltage generating unit 90. The voltage level control unit 80 includes a first voltage level control unit 80-1 and a second voltage level control unit 80-2. The first voltage level control unit 80-1 includes a control signal generating circuit 82-1 and a switching circuit 84-1. The switching circuit 84-1 includes an NMOS transistor N1. The second voltage level control unit 80-2 includes a control signal generating circuit 82-2 and a switching circuit 84-2. The switching circuit 84-2 includes an NMOS transistor N6. The internal power voltage generating unit 90 includes an amplifier OP2 and resistors R4, R5, R6 and R7.

The first voltage level control unit 80-1 decreases the level of an internal power voltage IVC when the internal power voltage IVC is higher than reference voltage. The second voltage level control unit 80-2 increases the level of an internal power voltage IVC when the internal power voltage IVC is lower than a reference voltage.

The mode setting unit 70 receives a command signal COM and a data signal Ai through an address input pin (not shown) and sets control signals MRS1, MRS2, MRS4, and MRS5. The control signal generating circuit 80-1 sets a state of a control signal OUT1 in response to the control signals MRS1 and MRS2 at a package level. The control signal generating circuit 80-2 sets a state of a control signal OUT2 in response to the control signals MRS4 and MRS5. The NMOS transistor N1 turns on when the control signal OUT1 is a logic "high" level. The NMOS transistor N6 is turns on when the control signal OUT2 is a logic "high" level. The amplifier OP2 compares a voltage at a node E with a reference voltage, and decreases the level of the internal power voltage IVC when a voltage at node E is higher than the reference voltage and increases the internal power voltage IVC when the voltage at node E is lower than the reference voltage. The resistors R4, R5, R6 and R7 serve to divide the internal power voltage IVC.

The internal power voltage generating circuit of FIG. 9 may output the internal power voltage IVC having a voltage level equal to (R4+R7)VREF/R7 in response to the control signals OUT1 and OUT2 having a logic "low" voltage. However, when a level of the internal power voltage IVC is higher than a reference voltage, the control signals OUT1 and OUT2 are set to a logic "high" level and a logic "low" level, respectively, whereupon a level of the internal power voltage IVC can be lowered to a voltage level equal to (R4+R5+R7)VREF/R7. On the other hand, when a level of the internal power voltage IVC is lower than a reference voltage, the control signals OUT1 and OUT2 are set to a logic "low" level and a logic "high" level, respectively, whereupon a level of the internal power voltage IVC can be increased to a voltage level equal to (R4+R6+R7)VREF/(R6+R7). The control signal generating circuits 82-1 and 82-2 are configured similar to the control signal generating circuit of FIG. 3.

Figure 10:
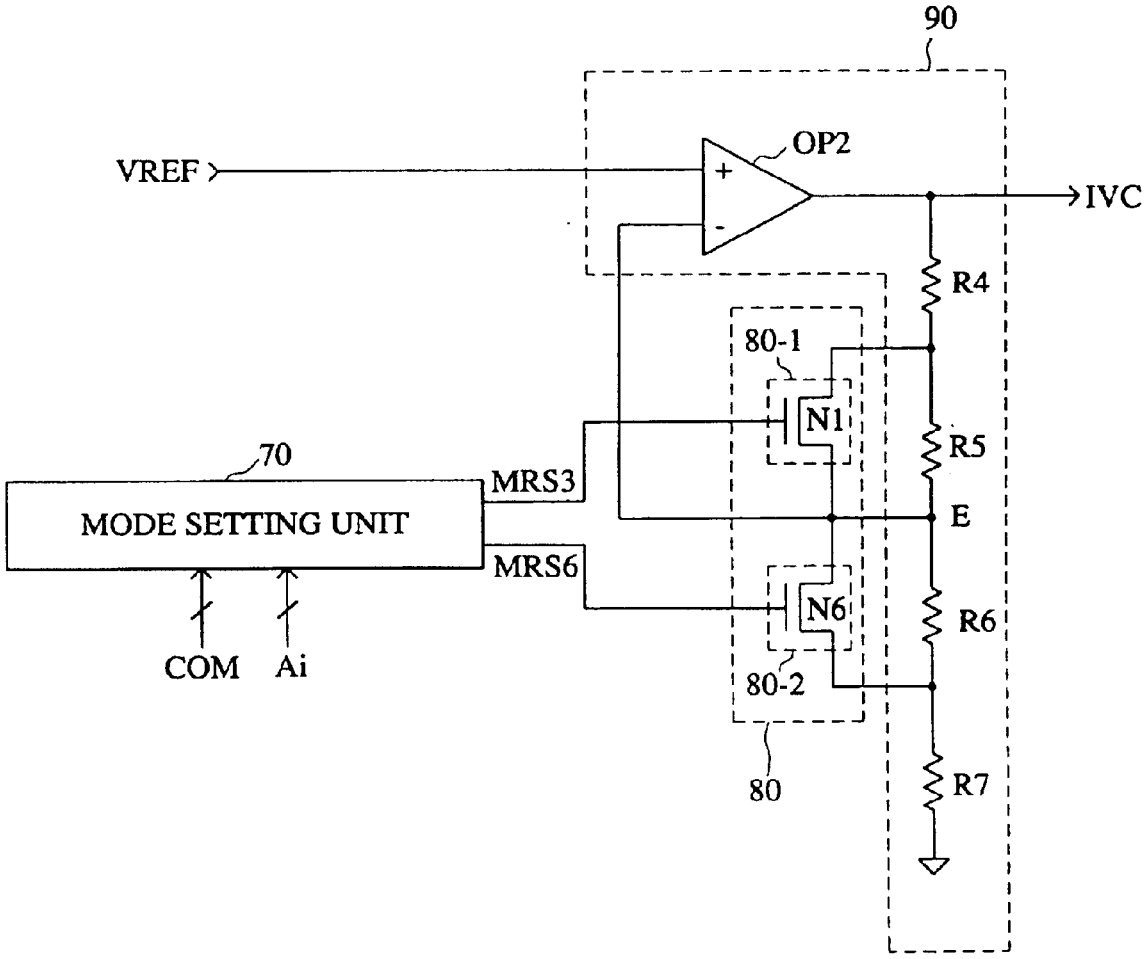
FIG. 10 is a circuit block diagram illustrating internal power voltage generating circuits according to further embodiments of the present invention.

Referring now to FIG. 10, a circuit block diagram illustrating an internal power voltage generating circuit according to further embodiments of the present invention will be discussed. As illustrated in FIG. 10, the internal power voltage generating circuit includes a mode setting unit 70, a voltage level control unit 80 and an internal power voltage generating unit 90. The voltage level control unit 80 includes a first voltage level control unit 80-1 and a second voltage level control unit 80-2. The first voltage level control unit 80-1 includes an NMOS transistor N1, and the second voltage level control unit 80-2 includes an NMOS transistor N6. The internal power voltage generating unit 90 includes an amplifier OP2 and resistors R4, R5, R6 and R7.

The mode setting unit 70 receives a command signal COM and a data signal Ai through an address input pin (not shown) and sets control signals MRS3 and MRS6. The NMOS transistor N1 turns on when the control signal MRS3 is a logic "high" level, and the NMOS transistor N6 turns on when the control signal MRS6 is a logic "high" level.

The internal power voltage generating circuit generates an internal power voltage IVC when the NMOS transistors N1 and N6 are turned off in response to the control signals MRS3 and MRS6 each having a logic "low" level, respectively. When a level of the internal power voltage IVC generated is higher than the reference voltage, the control signals MRS3 and MRS6 are set to a logic "high" level and a logic "low" level, respectively, whereby a level of the internal power voltage IVC is lowered. On the other hand, when a level of the internal power voltage IVC generated is lower than the reference voltage VREF, the control signals MRS3 and MRS6 are set to a logic "low" level and a logic "high" level, respectively, whereby a level of the internal power voltage IVC is increased.

It will be understood that the internal power voltage generating circuit of FIG. 9 may fix the states of the control signals OUT1 and OUT2, but the internal power voltage generating circuit of FIG. 10 typically sets the states of the control signals MRS3 and MRS6 whenever operated because the internal power voltage generating circuit of FIG. 10 does not include control signal generating circuits.

Figure 11:
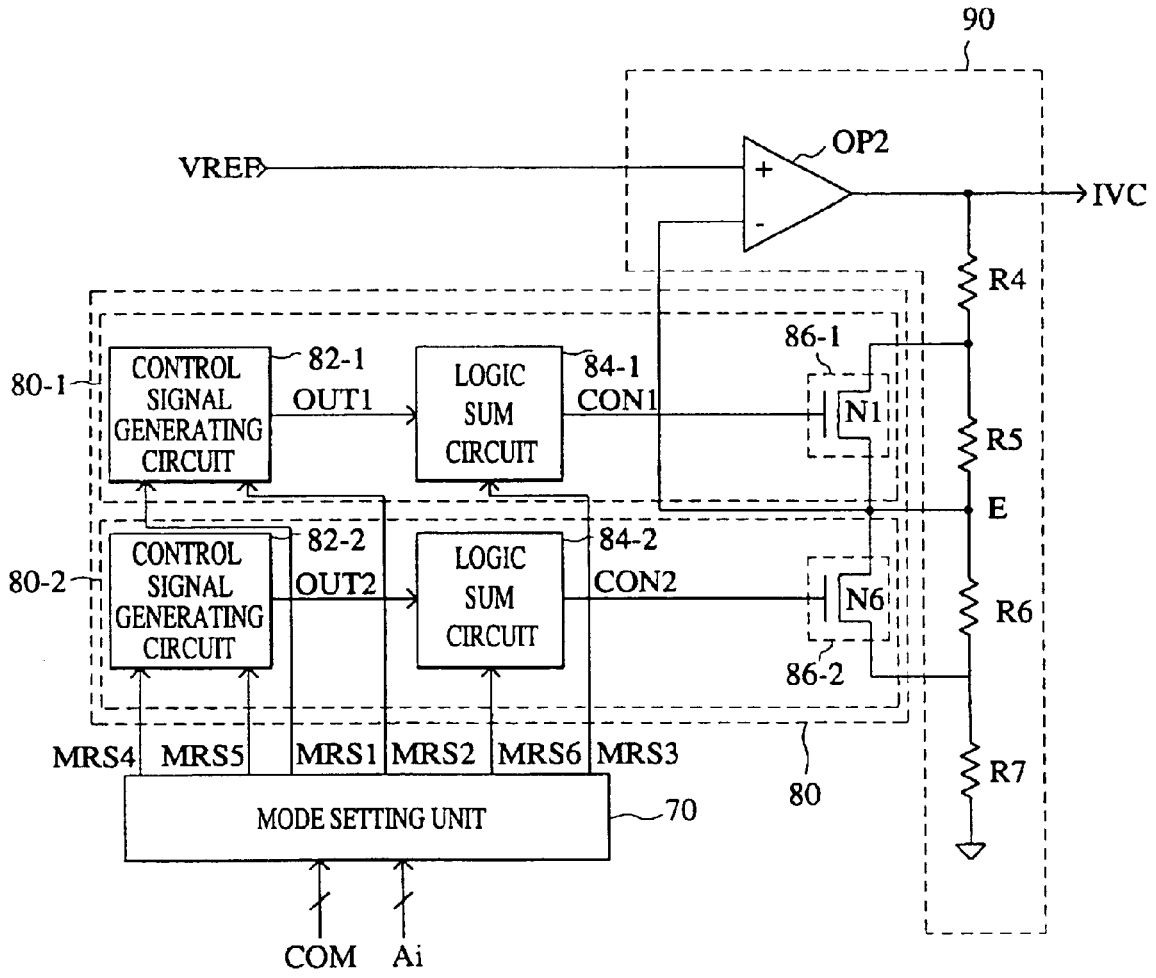
FIG. 11 is a circuit block diagram illustrating internal power voltage generating circuits according to further embodiments of the present invention.

Referring now to FIG. 11, a block diagram illustrating internal power voltage generating circuit according to further embodiments of the present invention will be discussed below. As illustrated in FIG. 11, the internal power voltage generating circuit includes a mode setting unit 70, a voltage level control unit 80 and an internal power voltage generating unit 90. The voltage level control unit 80 includes first and second voltage level control units 80-1 and 80-2. The first voltage level control unit 80-1 includes a control signal generating circuit 82-1, a logic sum circuit 84-1 and a switching circuit 86-1. The switching circuit 86-1 includes an NMOS transistor N1. The second voltage level control unit 80-2 includes a control signal generating circuit 82-2, a logic sum circuit 84-2 and a switching circuit 86-2. The switching circuit 86-2 includes an NMOS transistor N6. The internal power voltage generating unit 90 includes an amplifier OP2 and resistors R4, R5, R6 and R7.

The mode setting unit 70 receives a command signal COM and a data signal Ai through an address input pin (not shown) and sets control signals MRS1, MRS2, MRS3, MRS4, MRS5 and MRS6. The control signal generating circuit 82-1 sets the level of an output signal OUT1 in response to the control signals MRS1 and MRS2. The control signal generating circuit 82-2 sets the level of an output signal OUT2 in response to the control signals MRS4 and MRS5. The logic sum circuit 84-1 logic-sums the output signal OUT1 and the control signal MRS3 to generate a control signal CON1. The logic sum circuit 84-2 logic-sums the output signal OUT2 and the control signal MRS6 to generate a control signal CON2. The NMOS transistor N1 turns on in response to the control signal CON1, and the NMOS transistor N6 turns on in response to the control signal CON2. The internal power voltage generating unit 90 performs similar operations as the internal power voltage generator of FIG. 9 and the control signal generating circuits 82-1 and 82-2 have a similar configuration as the control signal generator illustrated in FIG. 3.

When the NMOS N1 and N6 transistors are turned off in response to the control signals CON1 and CON2 each having a logic "low" level, the internal power voltage generating unit 90 generates an internal power voltage IVC. When a level of the internal power voltage IVC is higher than a reference voltage, the control signals CON1 and CON2 are set to a logic "high" level and a logic "low" level, respectively. As a result, the NMOS transistor N1 is turned on, and the NMOS transistor N6 is turned off, thereby lowering a level of the internal power voltage IVC. On the other hand, when a level of the internal power voltage IVC is lower than the reference voltage, the control signals CON1 and CON2 are set to a logic "low" level and a logic "high" level, respectively. As a result, the NMOS transistor N1 is turned off, and the NMOS transistor N6 is turned on, thereby increasing a level of the internal power voltage IVC.

In the internal power voltage generating circuit of FIG. 11, a level of the internal power voltage can be increased or decreased such that a state of the control signals CON1 and CON2 may be fixed by fixing the state of the output signals OUT1 and OUT2 using control signal generating circuits 82-1 and 82-2. Alternatively, a level of the internal power voltage can be increased or decreased such that a state of the control signals CON1 and CON2 is set whenever operated.

Figure 12:
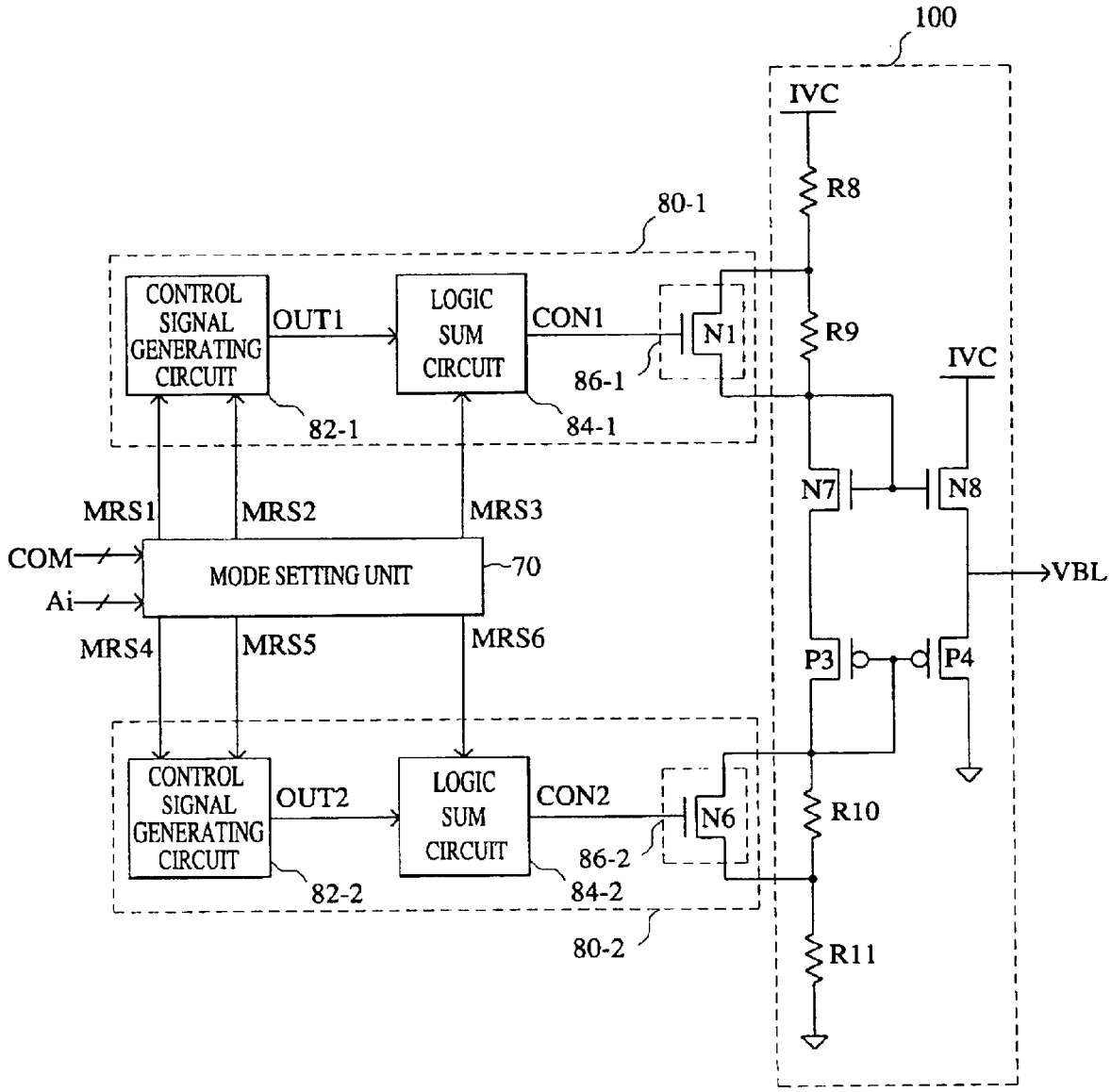
FIG. 12 is a circuit block diagram illustrating bit line pre-charge voltage generating circuits according to embodiments of the present invention.

Referring now to FIG. 12, a circuit block diagram illustrating a bit line pre-charge voltage generating circuit according to embodiments of the present invention will be discussed. As illustrated in FIG. 12, the bit line pre-charge voltage generating circuit includes a mode setting unit 70, first and second voltage level control units 80-1 and 80-2 and a bit line pre-charge voltage generating unit 100. The bit line pre-charge voltage generating unit 100 includes NMOS transistors N7 and N8, PMOS transistors P3 and P4, and resistors R8, R9, R10 and R11. The bit-line pre-charge voltage generating unit 100 is similar to a conventional bit-line pre-charge voltage generating circuit.

The NMOS transistor N1 includes a drain and a source, which are connected to both ends of the resistor R9. The NMOS transistor N6 includes a drain and a source, which are connected to both ends of the resistor R10. The functionality of the mode setting unit 70 is similar to the functionality of the mode setting unit of FIG. 11, thus, further discussion of the mode setting unit 70 will be omitted.

When the control signals CON1 and CON2 each having a logic "low" level are generated, the NMOS transistors N1 and N6 are turned on, whereupon the bit line pre-charge voltage generating unit 100 generates a bit line pre-charge voltage VBL. When the bit line pre-charge voltage VBL is higher than a reference voltage, i.e., a bit line pre-charge voltage in the specification, the control signals CON1 and CON2 are set to a logic "low" level and a logic "high" level, respectively. As a result, the NMOS transistor N1 is turned off, and the NMOS transistor N6 is turned on, whereupon a voltage applied to a gate of the NMOS transistor N8 is lowered, thereby decreasing the bit line pre-charge voltage VBL. On the other hand, when the bit line pre-charge voltage VBL is lower than a reference voltage, the control signals CON1 and CON2 are set to a logic "high" level and a logic "low" level, respectively. As a result, the NMOS transistor N1 is turned on, and the NMOS transistor N6 is turned off, whereupon a voltage applied to a gate of the NMOS transistor N8 is increased, thereby increasing the bit line pre-charge voltage VBL.

In other words, when the control signals CON1 and CON2 are generated each having a logic "low" level, the bit line pre-charge voltage VBL has a voltage equal to (R10+R11)IVC/(R8+R9+R10+R11). When the control signal CON1 has a logic "low" level and the control signal CON2 has a logic "high" level, the bit line pre-charge voltage VBL is decreased to a voltage equal to (R11)IVC/(R8+R9+R11). Furthermore, when the control signal CON1 has a logic "high" level and the control signal CON2 has a logic "low" level, the bit line pre-charge voltage VBL is increased to a voltage equal to (R10+R11)IVC/(R8+R10+R11).

Although the bit line pre-charge voltage generating circuit of FIG. 12 may lower the level of the bit line pre-charge voltage VBL using the first voltage level control unit 80-1 and increase the level of the bit line pre-charge voltage VBL using the second voltage level control unit 80-2, the present invention should not be limited to this configuration. Alternatively, the bit line pre-charge voltage generating circuit of FIG. 12 can be configured to have either the first or the second voltage level control units 80-1 and 80-2. If only the first voltage level control unit 80-1 is provided, the bit line pre-charge voltage generating circuit of FIG. 12 may lower a level of the bit line pre-charge voltage VBL. Similarly, if only the second voltage level control unit 80-2 is provided, the bit line pre-charge voltage generating circuit of FIG. 12 may increase the level of the bit line pre-charge voltage VBL.

It will be further understood that the bit line pre-charge voltage generating circuit of FIG. 12 can be configured such that the first and second voltage level control units 80-1 and 80-2 only include the control signal generating circuits 82-1 and 82-2 and the NMOS transistors N1 and N6 without the logic sum circuits 84-1 and 84-2. Furthermore, the first and second voltage level control units 80-1 and 80-2 may only include the NMOS transistors N1 and N6 and not the control signal generating circuits 82-1 and 82-2 and the logic sum circuits 84-1 and 84-2.

If the control signal generating circuits 82-1 and 82-2 and the NMOS transistors N1 and N6 are arranged without the logic sum circuits 84-1 and 84-2, a state of the control signals CON1 and CON2 may be fixed. If only the NMOS transistors N1 and N6 are arranged, the states of the control signals CON1 and CON2 are typically set whenever operated.

Figure 13:
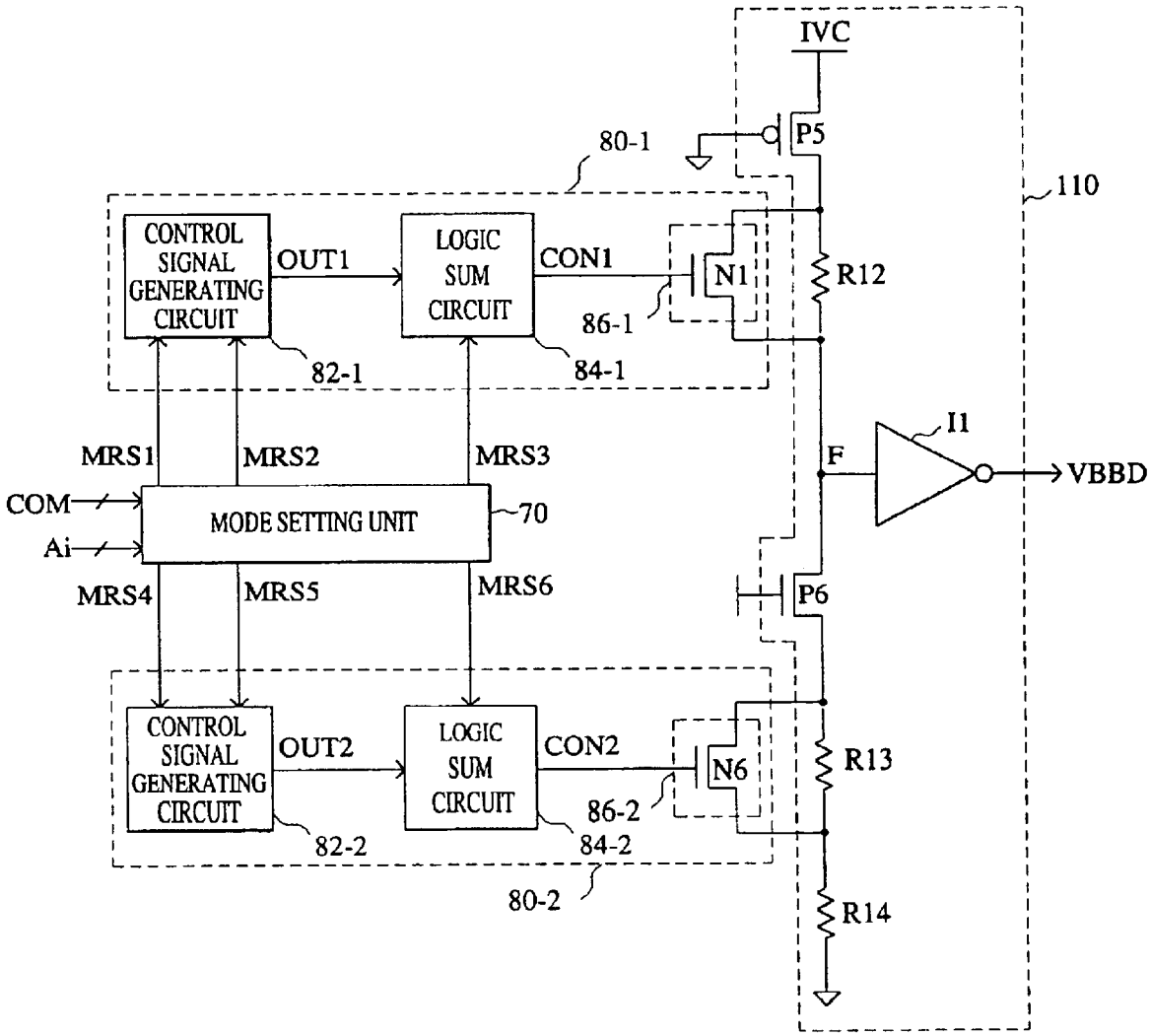
FIG. 13 is a circuit block diagram illustrating substrate voltage level detecting circuits according to embodiments of the present invention.

Referring now to FIG. 13, a circuit block diagram illustrating a substrate voltage level detecting circuit according to embodiments of the present invention will be discussed below. The substrate voltage level detecting circuit of FIG. 13 includes a mode setting unit 70, first and second voltage level control units 80-1 and 80-2, and a substrate voltage level detecting unit 110. The substrate voltage level detecting unit 110 includes PMOS transistors P5 and P6, resistors R12, R13 and R14, and an inverter I1.

The NMOS transistor N1 includes a drain and a source, which are connected to both ends of the resistor R12. The NMOS transistor N6 includes a drain and a source, which are connected to both ends of the resistor R13. The functionality of the mode setting unit 70 is similar to the functionality of the mode setting unit 70 of FIG. 12, thus, further discussion of the mode setting unit 70 will be omitted.

When the control signals CON1 and CON2 each having a logic "low" level are generated, the NMOS transistors N1 and N6 are turned off. When a level of a substrate voltage VBB is increased to a desired level, the substrate voltage level detecting unit 110 generates a substrate voltage level detecting signal VBBD. When the substrate voltage VBB is lower than a reference voltage, the control signals CON1 and CON2 are set to a logic "high" level and a logic "low" level, respectively. As a result, the NMOS transistor N1 is turned on, and the NMOS transistor N6 is turned off, thereby increasing a level of the substrate voltage VBB. On the other hand, when the substrate voltage VBB is higher than a substrate voltage on the specification, the control signals CON1 and CON2 are set to a logic "low" level and a logic "high" level, respectively. As a result, the NMOS transistor N1 is turned off, and the NMOS transistor N6 is turned on, thereby lowering a level of the substrate voltage VBB.

Although the substrate voltage generating circuit of FIG. 13 increases a level of the substrate voltage VBB using the first voltage level control unit 80-1 and lowers a level of the substrate voltage VBB using the second voltage level control unit 80-2, the present invention should not be limited to this configuration. Alternatively, the substrate voltage generating circuit of FIG. 13 can be configured to have either the first or the second voltage level control units 80-1 and 80-2. If only the first voltage level control unit 80-1 is provided, the level of the substrate voltage VBB may be increased. If, on the other hand, only the second voltage level control unit 80-2 is provided, it is possible to lower a level of the substrate voltage VBB.

It will be further understood that FIG. 13 is only an exemplary configuration of a substrate voltage generating circuit and the present invention should not be limited to this configuration. Alternatively, the substrate voltage generating circuit of FIG. 13 can be configured such that the first and second voltage level control units 80-1 and 80-2 only include the control signal generating circuits 82-1 and 82-2 and the NMOS transistors N1 and N6 and not the logic sum circuits 84-1 and 84-2. Furthermore, the first and second voltage level control units 80-1 and 80-2 may only include the NMOS transistors N1 and N6 without the control signal generating circuits 82-1 and 82-2 and the logic sum circuits 84-1 and 84-2.

If the control signal generating circuits 82-1 and 82-2 are provided without the logic sum circuits 84-1 and 84-2, a state of the control signals CON1 and CON2 may be fixed. If only the NMOS transistors N1 and N6 are provided, states of the control signals CON1 and CON2 may be set whenever operated.

Figure 14:
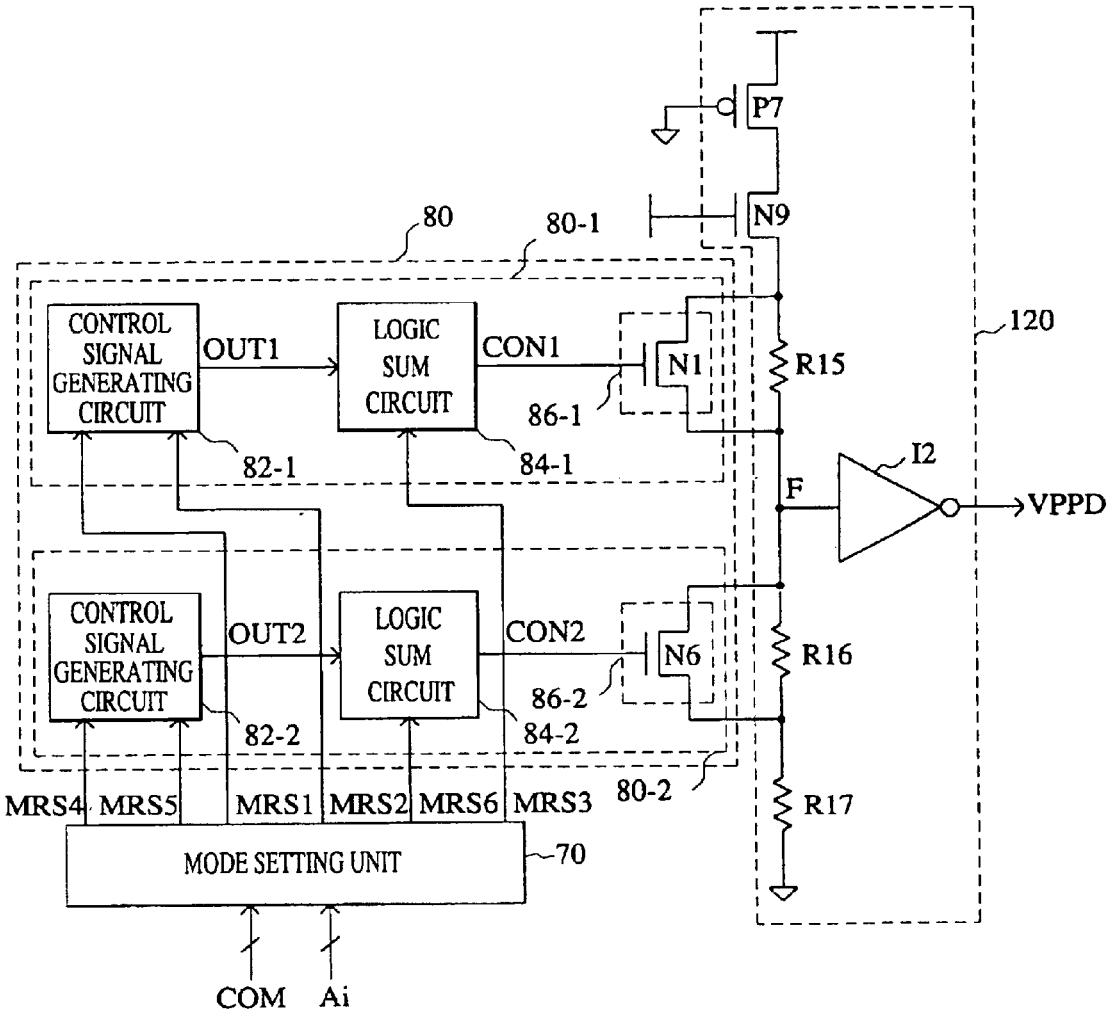
FIG. 14 is a circuit block diagram illustrating high voltage level detecting circuits according to embodiments of the present invention.

Referring now to FIG. 14, a circuit block diagram illustrating a high voltage level detecting circuit according to embodiments of the present invention will be described. As illustrated, the high voltage level detecting circuit may include a mode setting unit 70, first and second voltage level control units 80-1 and 80-2, and a high voltage level detecting unit 120. The high voltage level detecting unit 120 includes a PMOS transistor P7, an NMOS transistor N9, resistors R15, R16 and R17, and an inverter 12.

The NMOS transistor N1 includes a drain and a source, which are connected to both ends of the resistor R15, and the NMOS transistor N6 includes a drain and a source, which are connected to both ends of the resistor R16. The functionality of the mode setting unit 70 is similar to the functionality of the mode setting unit 70 of FIG. 12, thus, further discussion of the mode setting unit 70 will be omitted.

When the control signals CON1 and CON2 each have a logic "low" level, the NMOS transistors N1 and N6 are turned off, so that the high voltage level detecting unit 120 generates a high voltage level detecting signal VPPD when a level of a high voltage VPP is lower than a reference voltage. When a level of the high voltage VPP is lower than a reference voltage, the control signals CON1 and CON2 are set to a logic "low" level and a logic "high" level, respectively. As a result, the NMOS transistor N1 is turned off, and the NMOS transistor N6 is turned on, thereby increasing a level of the high voltage VPP. On the other hand, when a level of the high voltage VPP is higher than a reference voltage, the control signals CON1 and CON2 are set to a logic "high" level and a logic "low" level, respectively. As a result, the NMOS transistor N1 is turned on, and the NMOS transistor N6 is turned off, thereby lowering a level of the high voltage VPP.

It will be understood that although the high voltage generating circuit of FIG. 14 lowers a level of the high voltage VPP using the first voltage level control unit 80-1 and increases a level of the high voltage VPP using the second voltage level control unit 80-2, the present invention should not be limited to this configuration. Alternatively, the high voltage generating circuit of FIG. 14 may have either the first or the second voltage control unit and not both.

It will be further understood that although one configuration of the high voltage generating circuit is illustrated in FIG. 14, the present invention should not be limited to this configuration. Alternatively, the high voltage generating circuit of FIG. 14 can be configured such that the first and second voltage level control units 80-1 and 80-2 only include the control signal generating circuits 82-1 and 82-2 and the NMOS transistors N1 and N6. Furthermore, the first and second voltage level control units 80-1 and 80-2 may only include the NMOS transistors N1 and N6.

Figure 15:
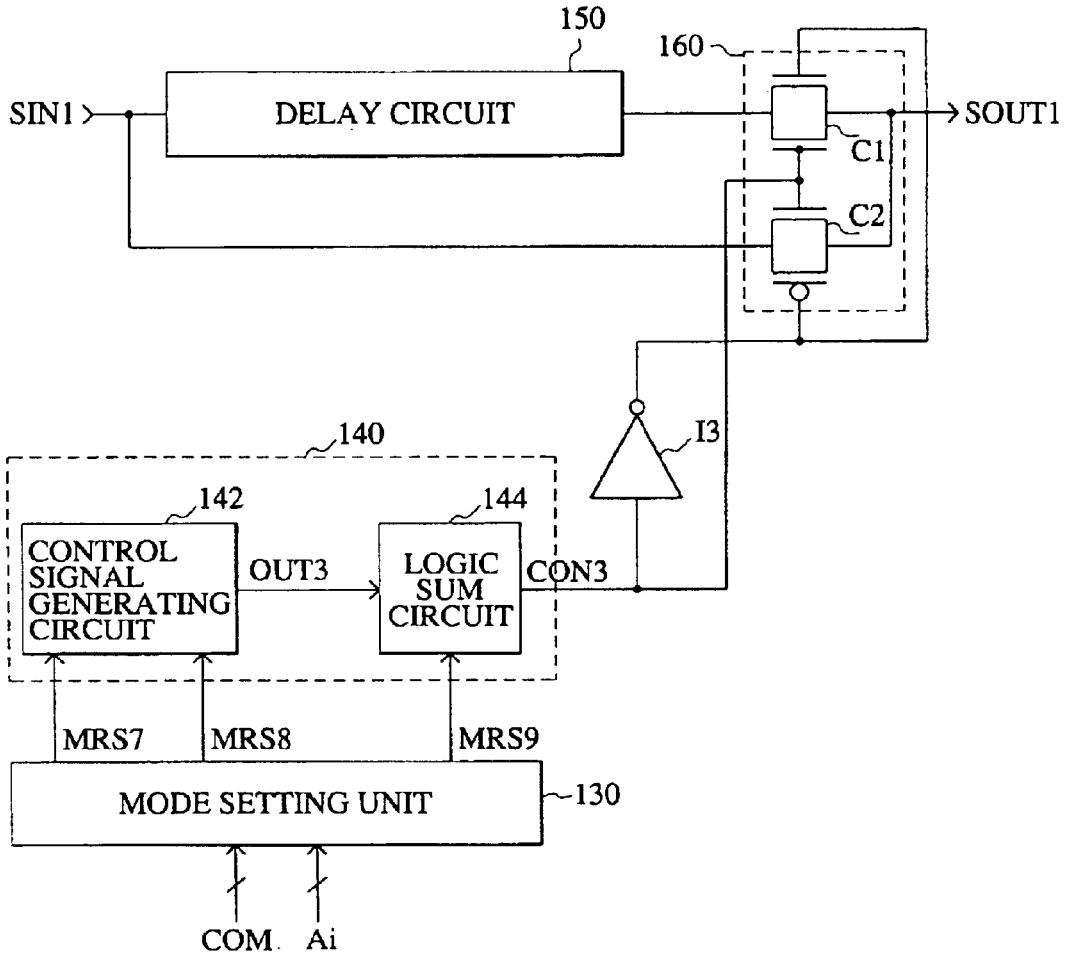
FIG. 15 is a circuit block diagram illustrating signal delay time control circuits according to embodiments of the present invention.

Referring now to FIG. 15, a circuit block diagram illustrating a signal delay time control circuit according to embodiments of the present invention will be discussed. The signal delay time control circuit of FIG. 15 includes a mode setting unit 130, a control signal generating unit 140, a delay circuit 150, an inverter 13, and a delay time control unit 160. The control signal generating unit 140 includes a control signal generating circuit 142 and a logic sum circuit 144. The delay time control unit 160 includes CMOS transmission gates C1 and C2.

The configuration and operation of the mode setting unit 130, the control signal 142 and the logic sum circuit 144 are similar to the configuration and operation of like named elements described above and, thus, further description of these elements will be omitted.

When the control signal generating unit 140 generates the control signal CON3 having a logic "low" level, the inverter 13 converts the control signal CON3 to a logic "high" level. The CMOS transmission gate C1 turns on to generate an output signal of the delay circuit 150 as an output signal SOUT1. At this time, when a delay time of the output signal SOUT1 generated is longer than a reference delay time, the delay time of the output signal SOUT1 may be shortened.

On the other hand, when an output signal OUT3 is fixed to a logic "high" level by the control signal generating circuit 142, or when the control signal MRS9 having a logic "high" level is generated by the mode setting unit 130, the control signal generating unit 140 generates the control signal CON3 having a logic "high" level, and the inverter 13 converts the control signal CON3 to a logic "low" level. The CMOS transmission gate C2 turns on, whereupon an input signal SIN1 is output as the output signal SOUT1.

The signal delay time control circuit of FIG. 15 delays the input signal SIN1 using the delay circuit 150 and then generates a delayed input signal as the output signal SOUT1 when the control signal CON3 is a logic "low" level, and provides the input signal SIN1 as the output signal SOUT1 when the control signal CON3 is a logic "high" level.

Figure 16:
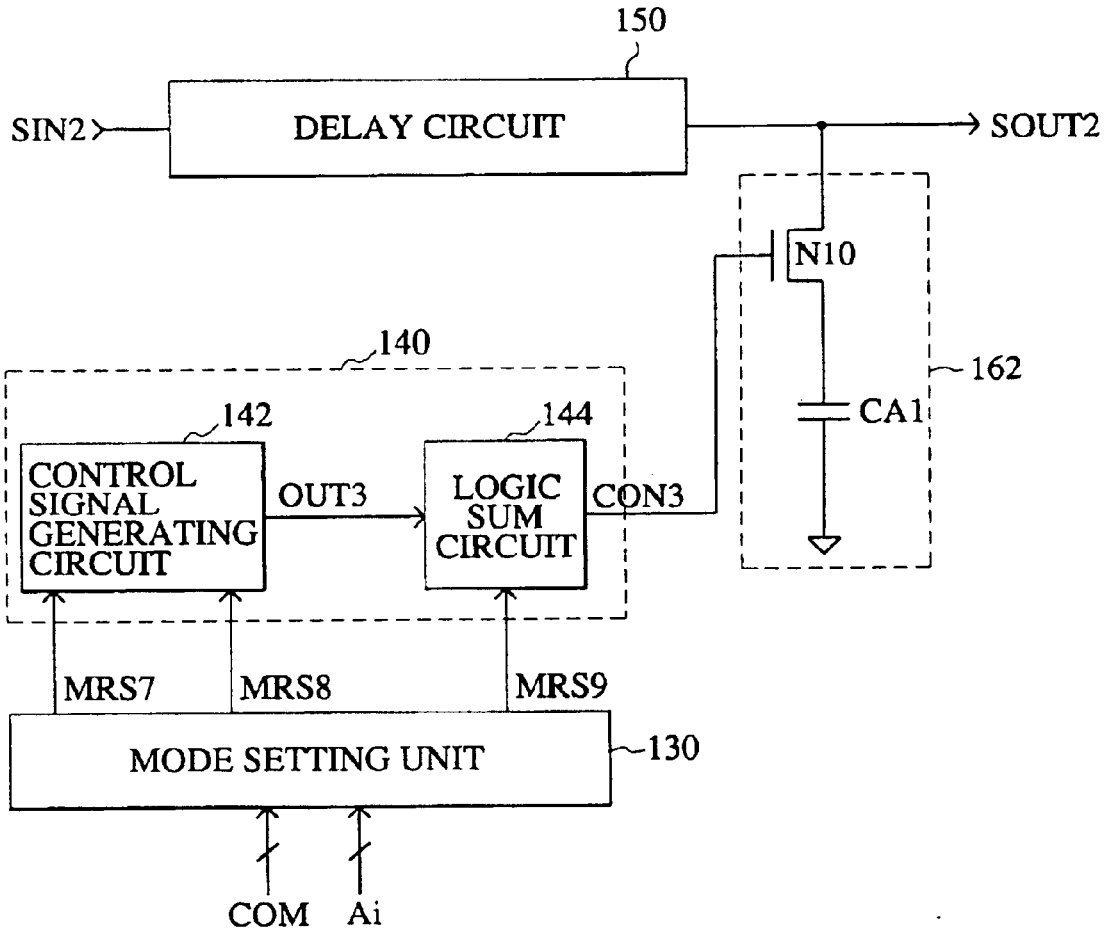
FIG. 16 is a circuit block diagram illustrating signal delay time control circuits according to further embodiments of the present invention.

Referring now to FIG. 16, a circuit block diagram illustrating signal delay time control circuits according to further embodiments of the present invention will be discussed. As illustrated, the signal delay time control circuit includes a mode setting unit 130, a control signal generating unit 140, a delay circuit 150, and a delay time control unit 162. The delay time control unit 162 includes an NMOS transistor N10 and a capacitor CA1. Like reference numerals of FIGS. 14 and 15 denote like components and perform like operation, thus, discussion of the operations of these components will be omitted.

When the control signal CON3 is a logic "low" level, the NMOS transistor N10 is turned off to generate an output signal of the delay circuit 150 as an output signal SOUT2. At this time, when a delay time of the output signal SOUT2 is shorter than reference delay time, a delay time of the output signal SOUT2 may be increased.

On the other hand, when the control signal CON3 is set to a logic "high" level, the NMOS transistor N10 is turned on, whereupon an output signal of the delay circuit 150 is delayed by the capacitor CA1 and output as the output signal SOUT2.

Figure 17:
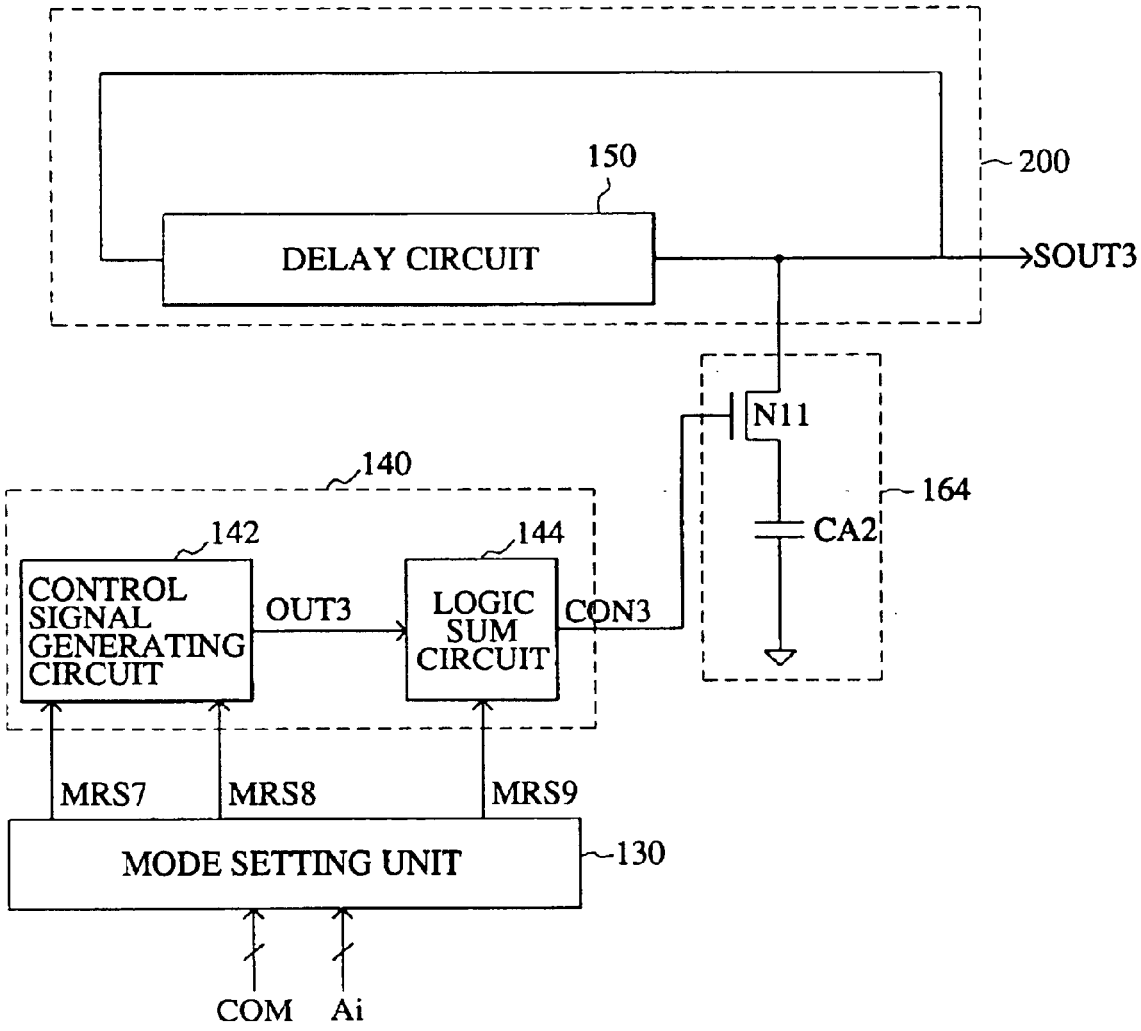
FIG. 17 is a circuit block diagram illustrating signal delay time control circuits according to further embodiments of the present invention.

Referring now to FIG. 17, a circuit block diagram illustrating signal delay time control circuits according to further embodiments of the present invention will be discussed below. As illustrated, the signal delay time control circuit may include a mode setting unit 130, a control signal generating unit 140, a delay time control unit 164, and a ring oscillator 200. The delay time control unit 164 includes an NMOS transistor N11 and a capacitor CA2. The oscillator 200 includes a delay circuit 150 configured in form of a ring. Like reference numerals of FIGS. 15 and 16 denote like components and perform like operations, thus, further discussion of these components and operations will be omitted.

When the control signal CON3 is a logic "low" level, the ring oscillator 200 acts as an original ring oscillator. At this time, if an output signal SOUT3 of the oscillator 200 has a shorter delay time than a reference delay time, the output signal SOUT3 of the ring oscillator 200 may be adjusted.

The control signal generating unit 140 sets the control signal CON3 having a logic "high" level to turn on the NMOS transistor N11. Thus, the output signal SOUT3 is generated by delaying an output signal of the delay circuit 150 by the capacitor CA2. In other words, the output signal SOUT3 is adjusted to a delay time on the specification by increasing a delay time of the output signal SOUT3.

It will be understood that although the signal delay time control circuit of FIG. 17 is configured to increase or decrease a delay time, the present invention should not be limited to this configuration. Alternatively, a signal delay time control circuit may be configured to increase and reduce a delay time using a single circuit.

As described above, an integrated circuit device is provided having voltage and/or time control circuits. The presence of the voltage and/or time control circuits in the integrated circuit device may allow the voltages and/or time delays of the integrated circuit devices to be adjusted to coincide with standard voltages and/or time delays. The ability to adjust the voltages and/or time delays may decrease the likelihood that an integrated circuit will be discarded as defective and, therefore, may increase the manufacturing yield of these integrated circuit devices.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. An integrated circuit device, comprising:

a mode setting unit that receives a plurality of input signals and sets at least one input control signal responsive to the plurality of input signals;

an internal power voltage generating unit that includes a comparing circuit and a corrected voltage generating circuit, the comparing circuit being configured to compare a corrected voltage to a reference voltage and generate an internal power voltage and the corrected voltage generating circuit being configured to generate a corrected voltage by dividing the internal power voltage; and a voltage level control unit including a control signal generating circuit and a switching circuit, the control signal generating circuit being configured to set a state of at least one output control signal responsive to the at least one input control signal and turn the switching circuit on and/or off in response to the at least one output control signal to control the corrected voltage.

2. The integrated circuit of claim 1 wherein the comparing circuit is configured to increase and/or decrease the circuit voltage based on a relationship between the corrected voltage and the reference voltage.

3. The integrated circuit of claim 2, wherein the internal power voltage generating unit increases the internal power voltage if the corrected voltage is less than the reference voltage and/or decreases the internal power voltage if the corrected voltage is greater than the reference voltage.

4. The integrated circuit of claim 1, wherein the corrected voltage generating circuit comprises serially connected resistors between the internal power voltage and a ground voltage and generates the corrected voltage by disconnecting and/or connecting at least one resistor by turning the switching circuit on and/or off.

5. The integrated circuit device of claim 1, wherein the control signal generating circuit comprises:

a first fuse having a first terminal coupled to a power supply voltage;

a first transistor having a drain coupled to a second terminal of the first fuse, a gate coupled to a first input control signal line and a source coupled to a ground voltage;

a second transistor having a source coupled to the second terminal of the first fuse, a gate coupled to a first node of the control signal generating circuit and a drain coupled to a second node of the control signal generating circuit;

a third transistor including a drain coupled to the second node of the control signal generating circuit, a gate coupled to a second input control signal line and a source coupled to the ground voltage;

a fourth transistor having a drain coupled to the second node of the control signal generating circuit, a gate coupled to the first node of the control signal generating circuit and a source coupled to the ground voltage;

a second fuse having a third terminal coupled to the power supply voltage;

a fifth transistor including a source coupled to a fourth terminal of the second fuse, a gate coupled to the second node of the control signal generating circuit and a drain coupled to the first node of the control signal generating circuit;

a sixth transistor including a drain coupled to the first node of the control signal generating circuit, a gate coupled to the second node of the control signal generating circuit and a source coupled to the ground voltage; and a seventh transistor including a drain coupled to the first node of the control signal generating circuit, a gate coupled to the second input control signal line and a source coupled to the ground voltage.

6. The integrated circuit of claim 5, wherein the first, third, fourth, sixth and seventh transistors comprise NMOS transistors and wherein the second and fifth transistors comprise PMOS transistors.

7. A method of controlling in an integrated circuit device, comprising:

receiving a plurality of input signals at a mode setting unit and setting at least one input control signal responsive to the plurality of input signals;

setting a state of at least one output control signal responsive to the at least one input control signal at a voltage level control unit including a control signal generating circuit and a switching circuit and turning the switching circuit on and/or off in response to the at least one output control signal to generate corrected voltage; and comparing the corrected voltage to a reference voltage and increasing and/or decreasing the internal power voltage responsive to the relationship between the corrected voltage and the reference voltage.

8. The method of claim 7, wherein increasing and/or decreasing further comprises:

determining if the corrected voltage is greater than or less than the reference voltage;

increasing the internal power voltage if the corrected voltage is less than the reference voltage; and decreasing the internal power voltage if the corrected voltage is greater than the reference voltage.

9. An integrated circuit device, comprising:

a mode setting unit that receives a plurality of input signals and sets at least one input control signal responsive to the plurality of input signals;

a voltage level control unit including a control signal generating circuit and a switching circuit, the voltage level control unit being configured to set a state of at least one output control signal responsive to the at least one input control signal and turn the switching circuit on and/or off in response to the at least one output control signal; and an internal power voltage generating unit that is configured to adjust a circuit voltage that is outside a predetermined circuit voltage specification to within the predetermined circuit voltage specification so that the integrated circuit device is no longer defective, wherein the control signal generating circuit comprises:

a first fuse having a first terminal coupled to a power supply voltage;

a first transistor having a drain coupled to a second terminal of the first fuse, a gate coupled to a first input control signal line and a source coupled to a ground voltage;

a second transistor having a source coupled to the second terminal of the first fuse, a gate coupled to a first node of the control signal generating circuit and a drain coupled to a second node of the control signal generating circuit;

a third transistor including a drain coupled to the second node of the control signal generating circuit, a gate coupled to a second input control signal line and a source coupled to the ground voltage;

a fourth transistor having a drain coupled to the second node of the control signal generating circuit, a gate coupled to the first node of the control signal generating circuit and a source coupled to the ground voltage;

a second fuse having a third terminal coupled to the power supply voltage;

a fifth transistor including a source coupled to a fourth terminal of the second fuse, a gate coupled to the second node of the control signal generating circuit and a drain coupled to the first node of the control signal generating circuit;

a sixth transistor including a drain coupled to the first node of the control signal generating circuit, a gate coupled to the second node of the control signal generating circuit and a source coupled to the ground voltage; and a seventh transistor including a drain coupled to the first node of the control signal generating circuit, a gate coupled to the second input control signal line and a source coupled to the ground voltage.

10. The integrated circuit of claim 9, wherein the first, third, fourth, sixth and seventh transistors comprise NMOS transistors and wherein the second and fifth transistors comprise PMOS transistors.

* * * * *